US006968717B2

(12) United States Patent
Suzuki et al.

(10) Patent No.: US 6,968,717 B2
(45) Date of Patent: Nov. 29, 2005

(54) CYLINDER LOCK

(75) Inventors: Kohji Suzuki, Kanagawa (JP); Yuichi Yoshizawa, Tokyo (JP); Takeshi Fukasawa, Kanagawa (JP); Tatsuya Kurosawa, Kanagawa (JP)

(73) Assignee: Alpha Corporation, Yokohama (JP)

( * ) Notice: Subject to any disclaimer, the term of this patent is extended or adjusted under 35 U.S.C. 154(b) by 0 days.

(21) Appl. No.: 10/220,273

(22) PCT Filed: Mar. 7, 2001

(86) PCT No.: PCT/JP01/01783

§ 371 (c)(1),
(2), (4) Date: Sep. 9, 2002

(87) PCT Pub. No.: WO01/66885

PCT Pub. Date: Sep. 13, 2001

(65) Prior Publication Data

US 2003/0089149 A1 May 15, 2003

(30) Foreign Application Priority Data

Mar. 9, 2000 (JP) ..... 2000-065800
Feb. 27, 2001 (JP) ..... 2001-052948

(51) Int. Cl.[7] ..... E05B 27/00

(52) U.S. Cl. ..... 70/492; 70/383; 70/367; 70/369

(58) Field of Search ..... 70/492, 495, 382–385, 70/367, 369, 370

(56) References Cited

U.S. PATENT DOCUMENTS 4,376,382 A * 3/1983 Raymond et al. ..... 70/338
4,404,824 A * 9/1983 Hennessy ..... 70/364 A
4,750,342 A * 6/1988 Nakai ..... 70/377 X
4,836,002 A * 6/1989 Monahan ..... 70/382
4,843,852 A * 7/1989 Foshee et al. ..... 70/367
4,942,749 A * 7/1990 Rabinow ..... 70/495
4,961,333 A * 10/1990 Rabinow ..... 70/495
4,966,021 A * 10/1990 Boag ..... 70/383
5,182,929 A * 2/1993 Myers ..... 70/337
5,209,088 A * 5/1993 Vaks ..... 70/384
5,325,690 A * 7/1994 Adler et al. ..... 70/383
5,765,417 A * 6/1998 Bolton ..... 70/495
5,956,986 A * 9/1999 Vonlanthen ..... 70/492
5,964,110 A * 10/1999 Crocco et al. ..... 70/369
6,295,850 B1 * 10/2001 Anderson ..... 70/492
2002/0116968 A1 * 8/2002 Shvarts ..... 70/370
2003/0154753 A1 * 8/2003 Dimig et al. ..... 70/495

FOREIGN PATENT DOCUMENTS

DE 195 44 840 A1 6/1997
EP WO 98/40589 9/1998
JP 9-235921 9/2001

OTHER PUBLICATIONS

Japanese Patent Abstract, Publication No.: 09235921, Publication Date: Sep. 9, 1997.
Japanese Patent Abstract, Publication No.: 09235922, Publication Date: Sep. 9, 1997.

* cited by examiner

*Primary Examiner*—Suzanne Dino Barrett
(74) *Attorney, Agent, or Firm*—Arent Fox PLLC

(57) ABSTRACT

A cylinder lock utilizing an unlocking code to set at any desired time after the cylinder lock has been assembled and which, before the setting of the unlocking code, allows the rotor to be rotated for the purpose of inproving the efficiency of the automotive assembly work. The cylinder lock includes a rotor in which tumblers are installed, is rotatably inserted in a cylinder case, the tumblers following a code forming portion of an inserted key plate to form a lock-side unlocking code that matches a key-side unlocking code defined by the code forming portion. The tumblers are put in a state where the lock-side unlocking code is formed, in response to an identification portion formed in the key plate.

20 Claims, 20 Drawing Sheets

CYLINDER LOCK

TECHNICAL FIELD

The present invention relates to a cylinder lock.

BACKGROUND ART

Conventionally, a locking device for cars, for example, comprises a plurality of cylinder locks corresponding to locking portions in the car and a key plate capable of unlocking these cylinder locks. The cylinder lock has a case and a rotor rotatable within the case. The rotor has a disk tumbler or pin tumbler therein to form a lock-side unlocking code.

The key plate for unlocking these cylinder locks has a key-side unlocking code set in a code forming portion. With the key plate inserted in the rotor, the tumbler occupies a predetermined position in the rotor, which is uniquely determined by the code forming portion. The tumbler position in the rotor and the rotate enable/disable state of the rotor are related with each other by an appropriate mechanism, so that only when a key plate having an unlocking code that matches the lock-side unlocking code is inserted, the rotor can be turned.

The conventional locking device, however, has the following drawback. That is, the lock-side unlocking code of the cylinder lock is determined beforehand during the assembly of the cylinder lock according to the kind and arrangement of the tumbler. Therefore, when a plurality of cylinder locks provided in, for example, doors, trunk and steering are to be locked or unlocked by the same key plate for each vehicle, the plurality of cylinder locks incorporating the tumblers having the same unlocking codes need to be managed as one group together with the key plate. If a cylinder lock which is outside the group management is assembled into the car, the locking portion provided by that cylinder lock cannot be accessed.

On the other hand, although cars are assembled in an automated production line, the cylinder locks described above each have a characteristic unlocking code. Therefore, the cylinder locks cannot be interchanged in the event of a failure or when some parts are not available. Further, because these cylinder locks must be handled as one group, the efficiency of car assembly deteriorates.

In a car production line or during a process of building houses, it is effective in improving the work efficiency to allow unspecified workers to unlock the door to enter a car or house. However, if, after installing a cylinder lock in a car or house, the worker inadvertently locks the door, only a person who owns a genuine key can enter the car or house, thereby significantly degrading the efficiency.

The present invention has been accomplished to overcome the above drawback and its object is to provide a cylinder lock which allows the unlocking code to be set easily at any desired time after the cylinder lock has been assembled, thereby improving the workability of car assembly.

DISCLOSURE OF INVENTION

According to the present invention, the object described above can be realized by a cylinder lock, wherein a rotor 3 in which tumblers 2 are installed, is rotatably inserted in a cylinder case 4, the tumblers 2 following a code forming portion 1*a* of an inserted key plate 1 to form a lock-side unlocking code that matches a key-side unlocking code defined by the code forming portion 1*a*, wherein the tumblers 2 are put in a state where the lock-side unlocking code is formed, in response to an identification portion 5 formed in the key plate 1.

The tumblers 2 installed in the rotor 3 form a lock-side unlocking code that has a one-to-one correspondence with an unlocking code set in each key plate 1. The lock-side unlocking code, when formed, allows the rotor to be turned by the key plate 1 having the unlocking code that matches the lock-side unlocking code. The tumblers 2 can maintain their state before the unlocking code is formed. With the insertion of the key plate 1, which has the identification portion 5, acting as a trigger, the tumblers 2 shift to a state where the lock-side unlocking code can be formed (unlocking code setting). Before the unlocking code is set, the rotor 3 need to have no one-to-one correspondence with the key plate 1 having the identification portion 5. For example, the rotor 3 may be able to be turned by any key plate 1 or can only be turned by a key plate 1 that has a particular unlocking code with a one-to-one correspondence with the rotor 3. Or the rotor may be able to be turned by a key plate 1 that has a straight code forming portion 1*a* as shown in FIG. 3C, which practically cannot be said to constitute the unlocking code. The code forming portion 1*a* of the key plate 1 may be formed in an outer circumferential cut end face or a side surface of the key plate 1. The tumblers 2 may be so-called pin tumblers shaped like pins, or disk tumblers shaped like plates.

When a key plate 1 with an identification portion 5 is inserted before the unlocking code is set, the tumblers 2 are put in a state where the unlocking code is constructed in response to the identification portion 5. Immediately after this, or through necessary operations thereafter, the tumblers 2 follow the geometry of the code forming portion 1*a* of the inserted key plate 1 to form a lock-side unlocking code that matches the unlocking code of the key plate 1. After the lock-side unlocking code has been set, the rotor can only be turned by a key plate 1 that has the same unlocking code as that formed in the original key plate 1. Therefore, the key plate 1 used to set the lock-side unlocking code can be used as the key plate for unlocking.

To form the lock-side unlocking code matching the key-side unlocking code constructed by the code forming portion 1*a* in such a manner as to follow the geometry of the code forming portion 1*a* of the inserted key plate 1 can be achieved, for example, by a cylinder lock which comprises:

key-driven tumblers 15 having their main moving direction (DM) in a plane perpendicular to a direction of insertion of a key plate 1 inserted in a rotor 3, the key-driven tumblers 15 being moved in the main moving direction (DM) to predetermined positions in the rotor 3 according to the code forming portion 1*a* of the inserted key plate 1;

lock tumblers 14 engageable with the key-driven tumblers 15 at appropriate positions in the main moving direction (DM);

a locking body 17 moving in a direction crossing the main moving direction (DM) to advance into or retract from a lock recess 25 on the cylinder case 4 side, the locking body 17 being enabled or disabled to retract from an advanced position in the lock recess 25 according to the positions of the lock tumblers 14 in the main moving direction (DM);

a code setting body 21 to keep the lock tumblers 14 and the key-driven tumblers 15 in an undisengageably meshed state;

wherein when the key plate 1 is inserted, the positions in the main moving direction (DM) of the lock tumblers 14 that enable the retraction of the locking body 17 into the rotor 3 are maintained and the code setting body 21 is activated.

In this invention, because the timing of setting the lock-side unlocking code can be shifted to a point in time after the assembly of the cylinder lock has been completed, there are the following advantages. First, during the manufacture of the cylinder lock, there is no need to select those tumblers from a plurality of kinds of tumblers which are necessary to form the lock-side unlocking code and to arrange them in a predetermined sequence. As a result, the same cylinder locks need only be manufactured, which in turn improves the manufacturing efficiency of the cylinder locks. Further, before the lock-side unlocking code is set, the cylinder locks do not have their own individuality in the form of the unlocking code, so that there is no need to manage as a group the individual cylinder lock and its associated key plate 1 with a particular unlocking code. This reduces the number of management steps. Further, because the setting of the lock-side unlocking code is effected simply by inserting the key plate 1, the code setting operation becomes simple, making the cylinder lock easy to use. Moreover, because the enabling or disabling of the rotation of the rotor 3 and the setting of the unlocking code are determined by the mechanical operation of the key plate 1 and the tumblers 2, the chances of erroneous operation is small compared with electronic verification and setting means, thus enhancing the reliability.

The cylinder lock may be constructed such that: a rotor in which tumblers are installed, is rotatably inserted in a cylinder case, the tumblers following a code forming portion of an inserted key plate to form a lock-side unlocking code that matches a key-side unlocking code defined by the code forming portion, wherein the rotor is rotatable with respect to the cylinder case before the lock-side unlocking code is formed.

In this invention, before the tumblers 2 form the lock-side unlocking code, they do not have a one-to-one correspondence with the code forming portion 1*a* of the key plate 1. Hence, when the cylinder lock is to be used as an automotive locking device, for example, there is no need to manage the lock and its key as a set and the number of management steps can be reduced. Further, during the manufacture of the cylinder lock, because it is not necessary to arrange different kinds of tumblers in a predetermined sequence in the rotor, the manufacturing efficiency improves.

Further, before the lock-side unlocking code is set, the rotor 3 can be rotated by all key plates 1, so that even if the lock is shifted to a locked state inadvertently, any key plate 1 or flat plate shaped like a key plate can be used to rotate the rotor 3 to the unlocked position, thus improving the work efficiency in the automotive production line.

Further, because the rotation of the rotor 3 is permitted before the lock-side unlocking code is set, when the lock is used in a house under construction, bringing the rotor 3 into the locked state can prevent the door from being opened simply by operating the knob, thus contributing to crime prevention.

Further, the tumblers 2 can construct a cylinder lock that sets the lock-side unlocking code in response to the rotation of the rotor 3. The lock-side unlocking code is formed (set) by inserting a key plate 1 with an identification portion 5 and then rotating the rotor 3. Because the rotation of the rotor 3 is required for the setting of the lock-side unlocking code, an inadvertent setting of the lock-side unlocking code simply by inserting the key plate 1 can be prevented.

It is also possible to form the lock-side unlocking code by a key plate 1 without an identification portion 5. The setting of the lock-side unlocking code is effected by inserting the unlocking code forming key plate 1 into the rotor 3 and then turning the rotor 3 by the key plate 1. In this case, the cylinder lock recognizes a key plate 1 which was first inserted and turned as the lock-side unlocking code setting key plate 1, and forms the lock-side unlocking code accordingly.

Further, in a cylinder lock in which the tumblers 2 can be restored from the lock-side unlocking code formed state to the state before the code was formed, it is possible to reset the once-set lock-side unlocking code and set the tumblers 2 to a different code of a new key plate 1. Hence, in the event that the key plate 1 is lost, the lock-side unlocking code needs only to be set again and there is no need to replace the lock.

Further, the cylinder lock may comprise:

key-driven tumblers 15 having their main moving direction (DM) in a plane perpendicular to a direction of insertion of a key plate 1 inserted in a rotor 3, the key-driven tumblers 15 being moved in the main moving direction (DM) to predetermined positions in the rotor 3 according to the code forming portion 1*a* of the inserted key plate 1;

lock tumblers 14 engageable with the key-driven tumblers 15 at appropriate positions in the main moving direction (DM) and a locking body 17 moving in a direction crossing the main moving direction (DM) to advance into or retract from a lock recess on the cylinder case side 4, the locking body 17 being enabled or disabled to retract from an advanced position in the lock recess 25 according to the positions of the lock tumblers 14 in the main moving direction (DM);

wherein the key-driven tumblers 15 are held in a tumbler guide block 26 in which they are urged in the main moving direction (DM), and the tumbler guide block 26 is mounted in the rotor 3 in such a manner that it is movable in a direction that engages the key-driven tumblers 15 with the lock tumblers 14 and urged in a direction that disengages the key-driven tumblers 15 from the lock tumblers 14;

wherein locking body 17 is urged to advance into the lock recess 25;

wherein when the key plate 1 is inserted, a lock-side unlocking code that matches a key-side unlocking code of the inserted key plate 1 can be formed by maintaining the lock tumblers 14 at positions in the main moving direction (DM) that allow the locking body 17 to retract into the rotor 3 and moving the tumbler guide block 26 in a direction that engages the key-driven tumblers 15 with the lock tumblers 14 to bring the lock tumblers 14 and the key-driven tumblers 15 into undisengageable mesh with each other.

The tumblers 2 are divided into the key-driven tumblers 15 and the lock tumblers 14. The key-driven tumblers 15 are moved in a predetermined direction (main moving direction (DM) in a plane perpendicular to the direction of insertion of the key plate 1 to follow the geometry of the code forming portion 1*a* of the key plate 1 inserted into the rotor 3. The lock tumblers 14 can select one of positions set in the main moving direction (DM) with respect to the key-driven tumblers 15 and at the selected position engage the key-driven tumblers 15. In the engaged state, the lock tumblers 14 can move together with the key-driven tumblers 15 in the main moving direction (DM).

The locking body 17 is accommodated in the rotor 3 in such a manner that it can advance to or retract from the lock recess 25 formed in the cylinder case 4. The locking body 17 is urged toward the lock recess 25 by an appropriate urging means. Whether the retraction of the locking body 17 from the lock recess 25 into the rotor 3 is permitted or not is determined by the position in the main moving direction (DM) of the lock tumblers 14. When the locking body 17 enters into the lock recess 25 and is prevented from retracting into the rotor 3 by the lock tumblers 14, the locking body 17 closes the rotation boundary surface of the rotor 3, thereby preventing the rotor 3 from being turned.

In the initial state in which the lock-side unlocking code is not yet set and the lock tumblers 14 and the key-driven tumblers 15 are disengaged from each other, when a key plate 1 is inserted, only the key-driven tumblers 15 are moved independently of the lock tumblers 14 to predetermined positions in the main moving direction (DM). The lock-side unlocking code is formed by first inserting the key plate 1 completely, moving the key-driven tumblers 15 in an engaging direction and then maintaining the engaged state. At this time, the lock tumblers 14 holds the positions in the main moving direction (DM) that permits the retraction of the locking body 17 into the rotor 3.

After the lock-side unlocking code has been formed, the key-driven tumblers 15 are moved by the urging force to predetermined positions carrying the lock tumblers 14 with them and the locking body 17 is projected into the lock recess 25 by the urging force, thus preventing the rotation of the rotor 3. After this, the lock tumblers 14 can only be moved to the positions that allow the locking body 17 to retract into the rotor 3 when the key plate unlocking code matches the genuine one. Otherwise, the locking body 17 engages in the lock recess 25 closing the rotation boundary surface to prevent the rotor 3 from being rotated by a key plate 1 with an unmatching unlocking code.

In this invention, therefore, because the key-driven tumblers 15 which follow the geometry of the code forming portion 1*a* of the inserted key plate 1 are applied an urging force in the main moving direction (DM), there is no need to make the key-driven tumblers 15 follow the geometry of the code forming portion 1*a* as by engaging the engagement projections of the key-driven tumblers 15 with the code forming portion 1*a* of the key plate 1. This allows the use of a commonly used key plate 1 having code forming notches at its side edges, thus improving the manufacturing efficiency of the key plate 1 and also widening the range of applications.

Further, by holding the key-driven tumblers 15 in the tumbler guide block 26, it is possible to precisely set a direction in which the key-driven tumblers 15 are guided. As a result, a faulty operation of the key-driven tumblers 15 as caused by undesired deviations of the moving direction can be prevented reliably, improving the operation reliability.

In addition, because the key-driven tumblers 15, the tumbler guide block 26 and the tumbler springs 27 applying an urging force to the key-driven tumblers 15 can be managed as a subassembly, the precision of movement of the key-driven tumblers 15 in the main moving direction (DM) can be enhanced and the manufacturing efficiency improved.

The relative positions between the lock tumblers 14 and the locking body 17 need only be on the positions in the main moving direction (DM) that allow the locking body 17 to be retracted into the rotor 3 at least when the lock-side unlocking code is formed. If this relative positions are maintained in the initial state, the rotor 3 can be turned whatever the unlocking code the key plate 1 has.

Further, the cylinder lock that applies an urging force to the key-driven tumblers 15 may comprise:

key-driven tumblers 15 having their main moving direction (DM) in a plane perpendicular to a direction of insertion of a key plate 1 inserted in a rotor 3, the key-driven tumblers 15 being moved in the main moving direction (DM) to predetermined positions in the rotor 3 according to the code forming portion 1*a* of the inserted key plate 1;

lock tumblers 14 engageable with the key-driven tumblers 15 at appropriate positions in the main moving direction (DM) and a locking body 17 moving in a direction crossing the main moving direction (DM) to advance into or retract from a lock recess 25 on the cylinder case 4 side, the locking body 17 being enabled or disabled to retract from an advanced position in the lock recess 25 according to the positions of the lock tumblers 14 in the main moving direction (DM);

wherein the key-driven tumblers 15 are urged in the main moving direction (DM) by tumbler springs 27 arranged in the rotor 3;

wherein the lock tumblers 14 are pushed by the locking body 17 toward the key-driven tumblers 15 to engage them with the key-driven tumblers 15 in such a manner that they can change their meshing positions in the main moving direction (DM);

wherein when the key plate 1 is inserted, a lock-side unlocking code that matches a key-side unlocking code of the inserted key plate 1 can be formed by maintaining the lock tumblers 14 at the positions in the main moving direction (DM) that enable the retraction of the locking body 17 into the rotor 3 and preventing the lock tumblers 14 from moving in a disengaging direction to hold the lock tumblers 14 and the key-driven tumblers 15 in undisengageable mesh with each other.

In this invention, the key-driven tumblers 15 and the lock tumblers 14 are already meshed in the initial state. The lock tumblers 14 are allowed to move in the disengaging direction in the initial state. The lock-side unlocking code is set by prohibiting the movement of the lock tumblers 14 in the disengaging direction.

That is, the key-driven tumblers 15 are movable guided by the rotor 3 in the main moving direction (DM) and are urged in the main moving direction (DM) to enable the use of the above-described key plate 1. The lock tumblers 14 are pushed by the locking body 17 to maintain the engagement with the key-driven tumblers 15 and are held at predetermined positions in the main moving direction (DM). In the initial state, the lock tumblers 14 can be moved in the disengaging direction. When the key plate 1 is inserted, the lock tumblers 14 are moved in the disengaging direction and held at the initial position while changing the engagement position relative to the key-driven tumblers 15. Then, after the lock-side unlocking code is set, the lock tumblers 14 are prevented from moving in the disengaging direction. After this, when a non-genuine key is inserted, the locking body 17 is prevented from moving into the rotor 3 thereby closing the rotation boundary surface of the rotor 3.

In this invention therefore, the lock tumblers 14, the locking body 17 and the code setting body 21 that restricts the movement of the lock tumblers 14 in the disengaging direction can be arranged close to each other. By closely arranging the movable portions, it is possible to set the dimensional relations between them highly accurately, improving the operation reliability and manufacturing efficiency.

In the inventions according to claim 5 and subsequent claims, the lock-side unlocking code can be formed by moving the code setting body 21 in the direction of insertion of the key plate 1. In the inventions according to claim 5 and subsequent claims in which the lock-side unlocking code can be formed by preventing either of the lock tumblers 14 or the key-driven tumblers 15 from moving in the disengaging direction, the enabling or disabling of the movement of the moving side tumblers 2 in the disengaging direction can be easily realized, for example, by matching the position to which the code setting body 21 is to be moved with the closing or releasing of the outward path of the moving side tumblers 2. This simplifies the construction, prevents possible failures and improves reliability. Further, by making the code setting body 21 movable in the direction of insertion of the key plate 1, i.e., in the longitudinal direction of the cylinder case 4, the longitudinal dimension of the cylinder case 4 can be used as the movement space for the code setting body 21. This minimizes the size of the cylinder lock.

In that case, although the code setting body 21 can be directly operated manually, it may be constructed of a drive spring 22 for urging the code setting body 21 toward the disengagement disable position and a stopper 23 for locking and holding the code setting body 21 at the disengagement enable position wherein the stopper 23 is released to allow the code setting body 21 to move toward the disengagement disable position by the recovery force of the drive spring 22. This construction can automatically form the lock-side unlocking code only by releasing the stopper 23, simplifying the operation.

The operation of the stopper 23 may be performed, for example, by manually pushing down or pulling up the end of the stopper 23 exposed from the cylinder case 4. The operability of the stopper 23 can be improved by the following construction. The stopper 23 may be installed in the rotor 3 in such a manner that it is urged to move out of the rotor 3 and movable in the main moving direction (DM). The stopper 23 is made to retract, by the insertion of the key plate 1, into the rotor 3 to disengage from the code setting body 21. This construction automatically forms the lock-side unlocking code simply by inserting the key plate 1.

A further improvement may be made by adopting a construction in which the stopper 23 is installed in the rotor 3 in such a manner that it is urged toward the outside of the rotor 3 and movable in the main moving direction (DM); in which the insertion of the key plate 1 causes the stopper 23 to move inwardly of the rotor 3; and in which, after the key plate 1 is inserted and the rotor 3 is rotated a predetermined angle, the stopper 23 disengages from the code setting body 21. In this construction, because the lock-side unlocking code is not formed before the rotor 3 is rotated a predetermined angle after the key plate 1 has been inserted, a trouble can be eliminated that a person unaware that the lock is in the initial state may insert the key plate 1 and inadvertently set the lock-side unlocking code.

Further, if the stopper 23 is constructed to be operated by the identification portion 5 formed in the key plate 1, the lock-side unlocking code can only be set by a predetermined key plate 1. This further improves the reliability in terms of setting the lock-side unlocking code. This also makes it possible to rotate the rotor 3 while maintaining the initial state by using a temporary key plate 1 that has no identification portion 5.

In these figures, reference number 1 represents a key plate; 1*a*: a code forming portion; 2: a tumbler; 3: a rotor; 4: a cylinder case; 5: an identification portion; 14: a lock tumbler; 15: a key-driven tumbler; 20: a detection portion; 21: a code setting body; 22: an operating spring; 23: a stopper; 25: a lock recess; 26: a tumbler guide block; 27: a tumbler spring; and DM: a main moving direction.

BEST MODE FOR CARRYING OUT THE INVENTION

Figure 1:
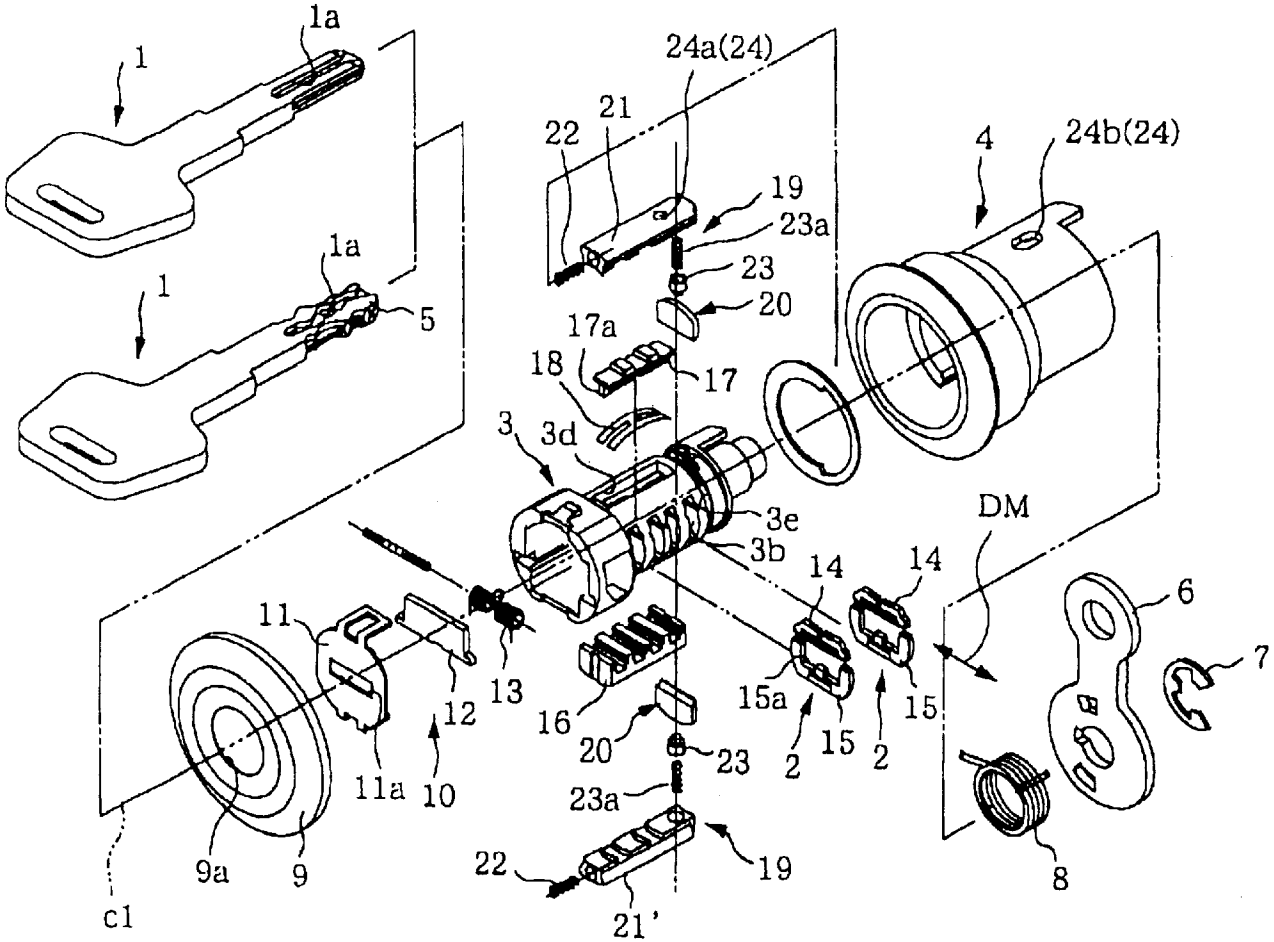
FIG. 1 is an exploded perspective view of this invention.
Figure 2:
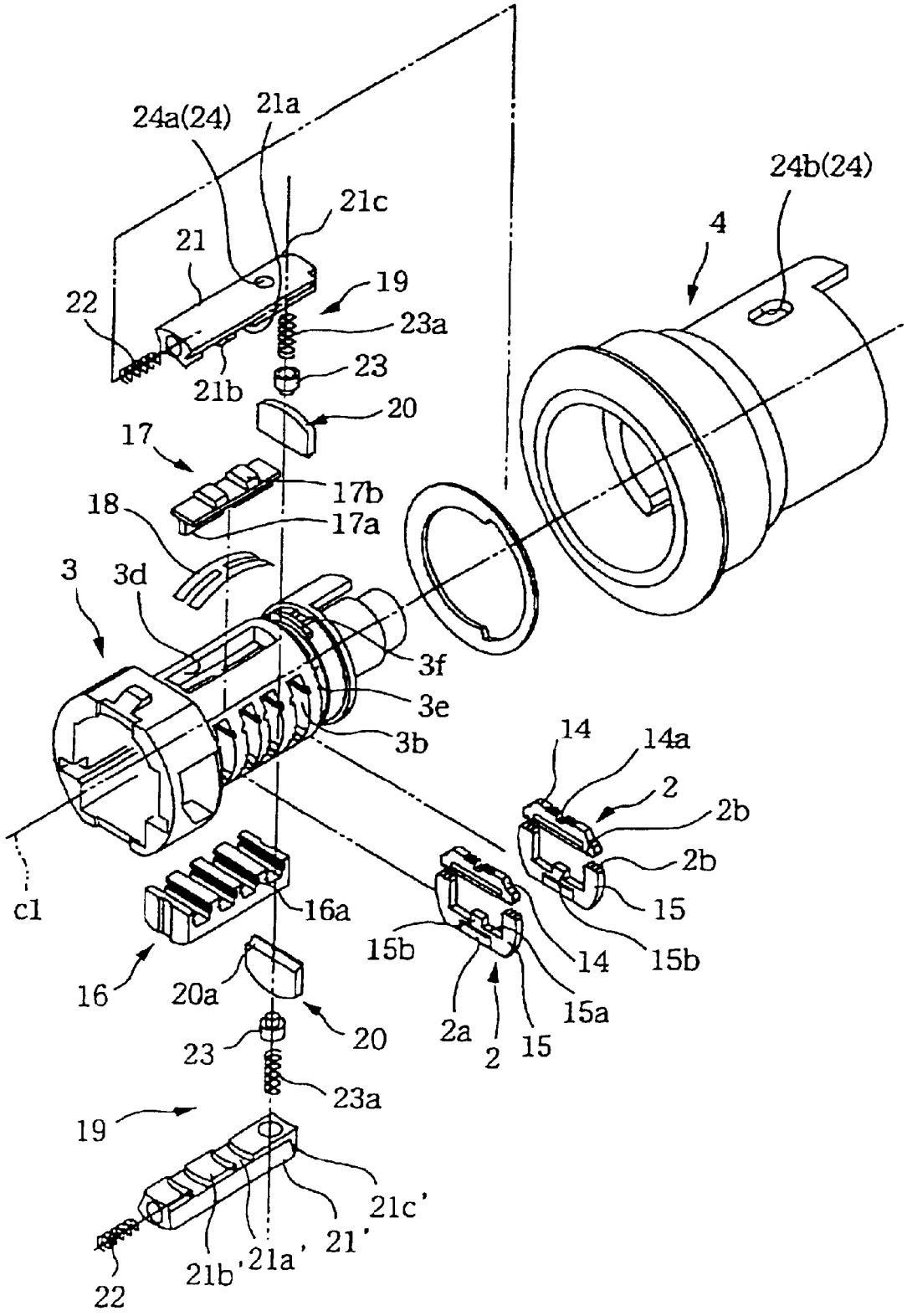
FIG. 2 is an essential-part enlarged view of FIG. 1.

FIGS. 1 and 2 show one embodiment of an automotive door lock. In this embodiment, a cylinder lock is formed such that a rotor 3 is rotatably inserted in a cylinder case 4. A lever 6 is secured to the end of the rotor 3 by a clip 7 so that the rotating of the rotor 3 can operate the door lock accommodated in the automotive door through a rod connected to the lever 6. The rotor 3 is urged toward an initial rotary position described later by a return spring 8 retained in the cylinder case 4.

The head portion of the cylinder case 4 is covered by a cover 9 having a keyhole 9*a*, which is closed by a shutter portion 10 fitted to the front end of the rotor 3. The shutter portion 10 has a shutter cover 11 formed with a key insertion hole 11*a* at the center thereof, a shutter plate 12 for closing the key insertion hole 11*a*, and a shutter spring 13 for urging the shutter plate 12 and the shutter cover 11 toward the front thereof, thus preventing a gap from being formed at a boundary between the parts.

Figure 4:
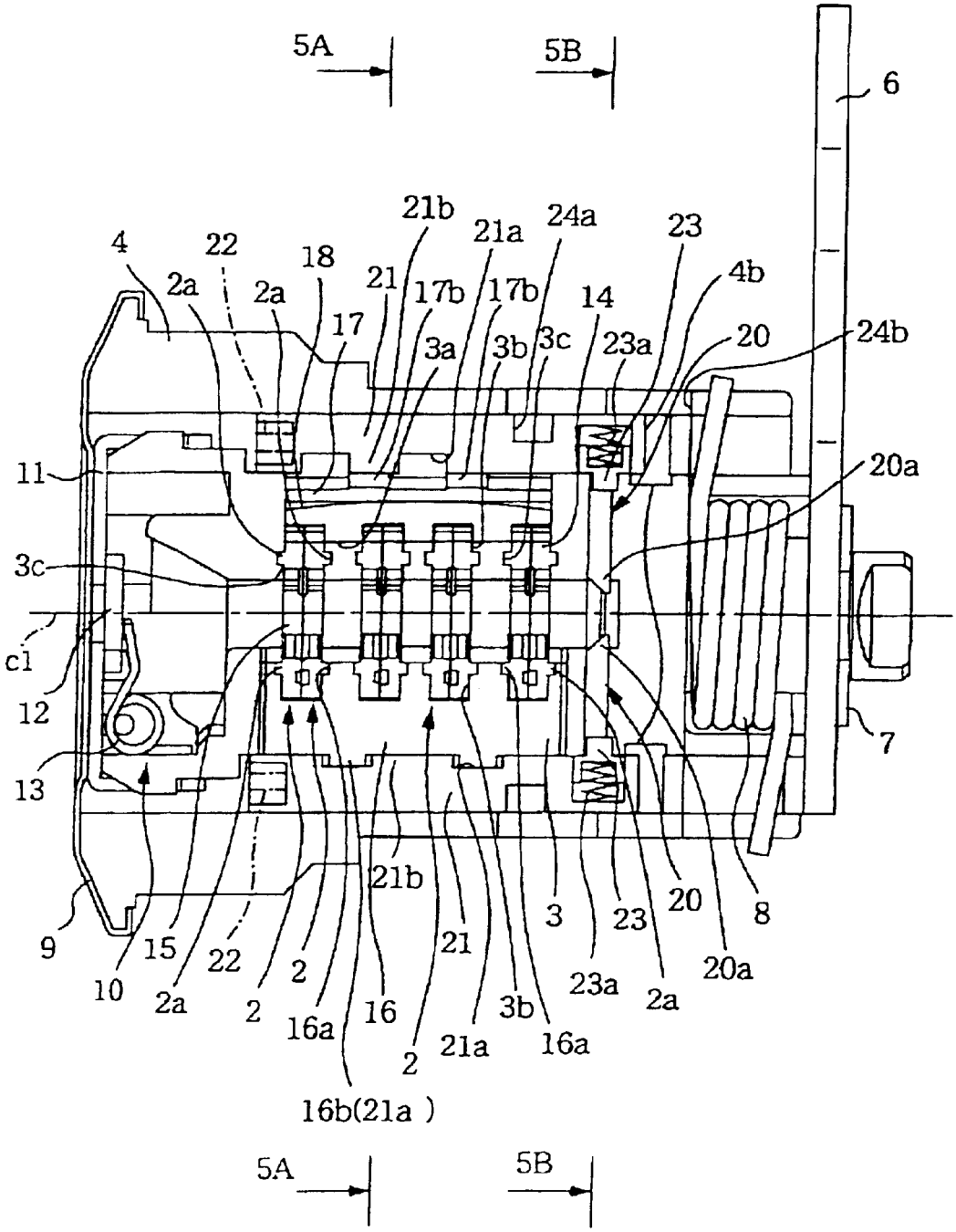
FIG. 4 is a cross section view of a cylinder lock in an initial state.

As shown in FIG. 4, the rotor 3 has a key insertion groove 3*a* and tumbler grooves 3*b*. The key insertion groove 3*a* penetrates longitudinally therethrough, whereas the tumbler grooves 3*b* holds a plurality of tumblers 2, 2, . . . along the key insertion groove 3*a* to be movable in a predetermined direction (main moving direction DM) in a plane perpendicular to an insertion axis c1 of the key plate 1. Each of the tumblers 2 is divided into a lock tumbler 14 and a key-driven tumbler 15. As shown in FIG. 4, to accommodate as many sets of tumblers as possible in the direction of key plate insertion axis c1, a pair of tumblers 2 are combined as one set and installed in the rotor 3 such that their surfaces which are opposite to surfaces having guide projections 2*a* described later are in contact with each other.

The lock tumbler 14 has a guide projection 2*a* on either the front or back surface thereof, as shown in FIG. 4. The guide projection 2*a* is fitted into a guide groove 3*c* on the rotor 3 side to allow the lock tumbler 14 to move only in the main moving direction (DM). The lock tumbler 14 has an unlock enable notch 14*a* formed in the upper end face thereof.

The key-driven tumbler 15 has an insertion recess 15*a* for the key plate 1 recessed at the central portion of one side edge thereof. An engagement projection 15*b* is projected at a bottom wall of the insertion recess 15*a*, which can fit into a code forming groove (code forming portion) 1*a* of the key plate 1. The key-driven tumbler 15 has the guide projection 2*a* on either the front or back surface thereof and the guide projection 2*a* is fitted in a guide groove 16*a* of a tumbler holding block 16. The tumbler holding block 16 is installed in the rotor so as to be movable in a direction perpendicular to the main moving direction (DM), and the guide grooves 16*a* guide the key-driven tumblers 15 in the main moving direction (DM).

Figure 5A:
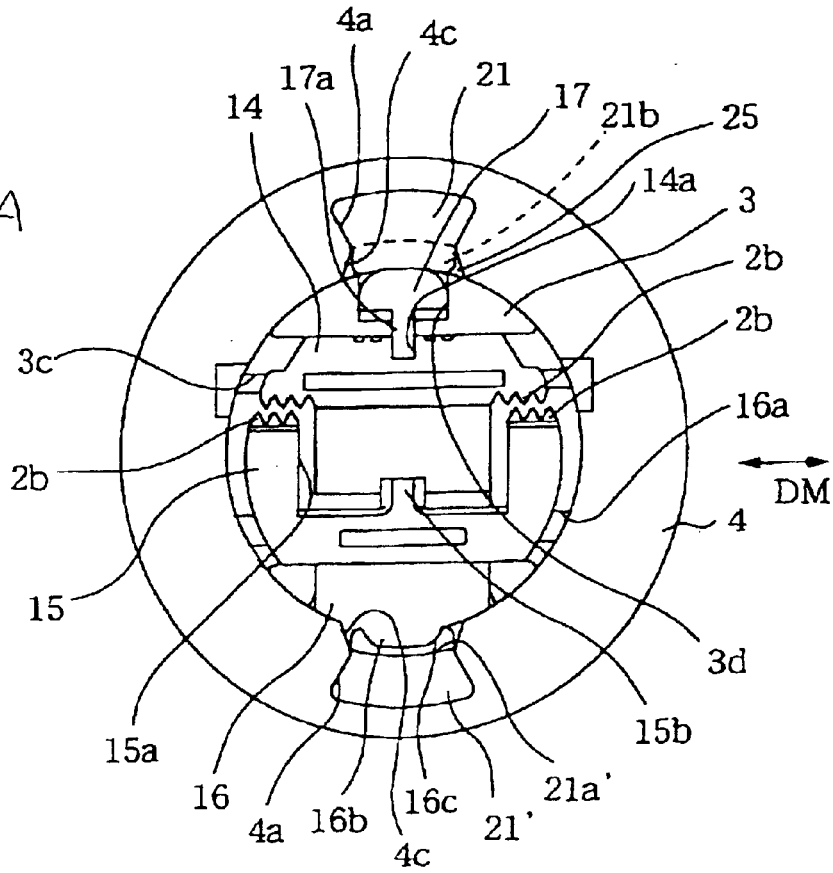
FIGS. 5A and 5B are views illustrating cross sections of FIG. 4, FIG. 5A being a cross sectional view taken along the line 5A—5A of FIG. 4 and FIG. 5B being a cross section view taken along the line 5B—5B of FIG. 4.
Figure 8A:
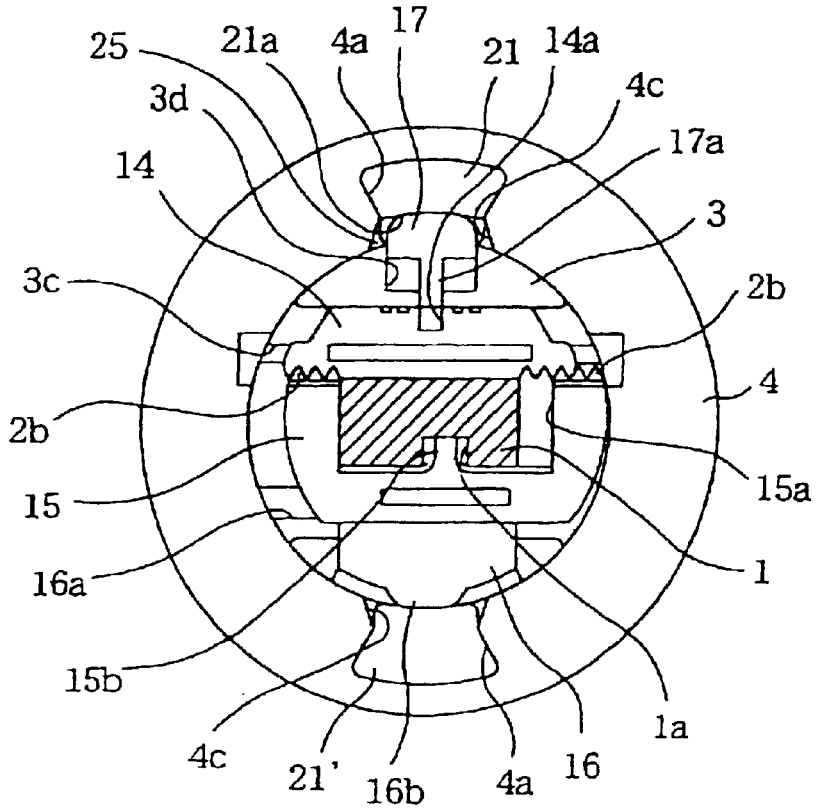
FIGS. 8A and 8B are views illustrating a state in which the unlocking code setting is completed, FIG. 8A being a view corresponding to FIG. 5A and FIG. 8B being a view corresponding to FIG. 5B.
Figure 8B:
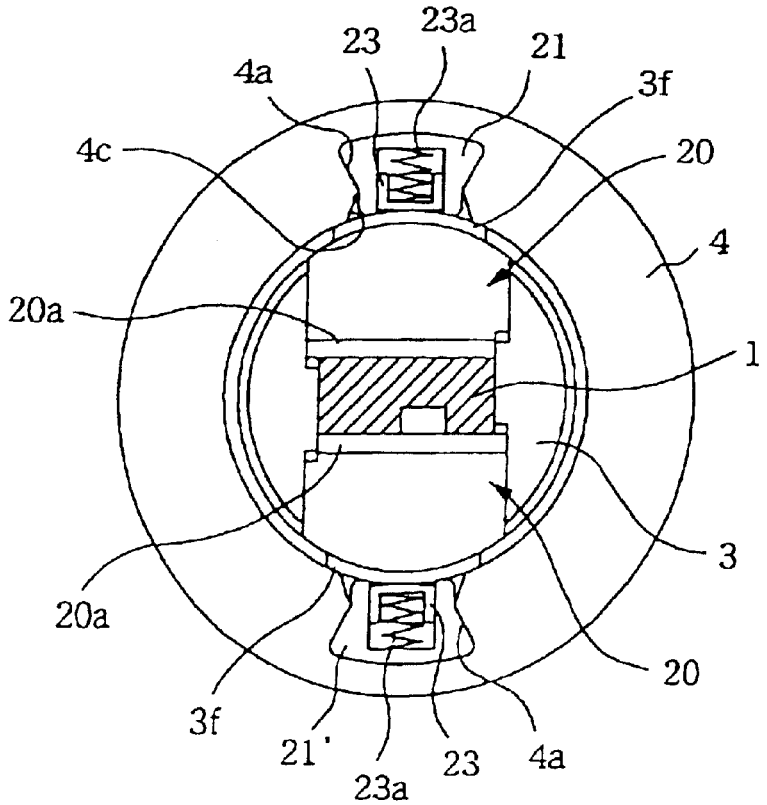

The key-driven tumbler 15 and the lock tumbler 14 are formed by dividing one tumbler plate into two in the direction of thickness of the key plate 1. As shown in FIG. 5A, their divided surfaces are formed with saw-tooth meshing projections 2*b* at a predetermined pitch. As shown in FIG. 8A, the key-driven tumbler 15 and the lock tumbler 14 can change their engagement position of the meshing projections 2*b*. The change of the engagement position can change a relative position between the engagement projection 15*b* of the key-driven tumbler 15 and the unlock enable notch 14*a* of the lock tumbler 14. The pitch of the meshing projections 2*b* corresponds to the kind of the code forming groove 1*a* of the key plate 1. Each of the meshing projections 2*b* has its both sides inclined and the inclined sides of the opposing tumblers are abutted to each other to maintain their engagement state. If, in the engagement state, either of the tumblers is forcibly moved sideways, the engaged projections of one tumbler ride over the inclined sides of the other tumbler to release the engagement once, and then mesh with adjoining projections 2*b* of the other tumbler.

The rotor 3 has a side bar accommodating portion 3*d* formed in the upper part thereof, and a side bar (lock body) 17 is installed movable in a direction perpendicular to the main moving direction (DM). As shown in FIG. 2, the side bar 17 is a member elongated in the direction of the insertion axis c1 of the key plate 1, extending to almost the entire length of the tumbler mounting area of the rotor 3. The side bar 17 has a raised stopper strip 17*a* extending longitudinally on the bottom surface thereof. The raised stopper strip 17*a* enters from the opening of the side bar accommodating portion 3*d* into a sliding area of the lock tumbler 14, so as to engage the unlock enable notch 14*a* of the lock tumbler 14 (see FIG. 5A). A leaf spring 18 is interposed between the side bar 17 and the rotor 3 to urge the side bar 17 to move out of the rotor 3.

Figure 5B:
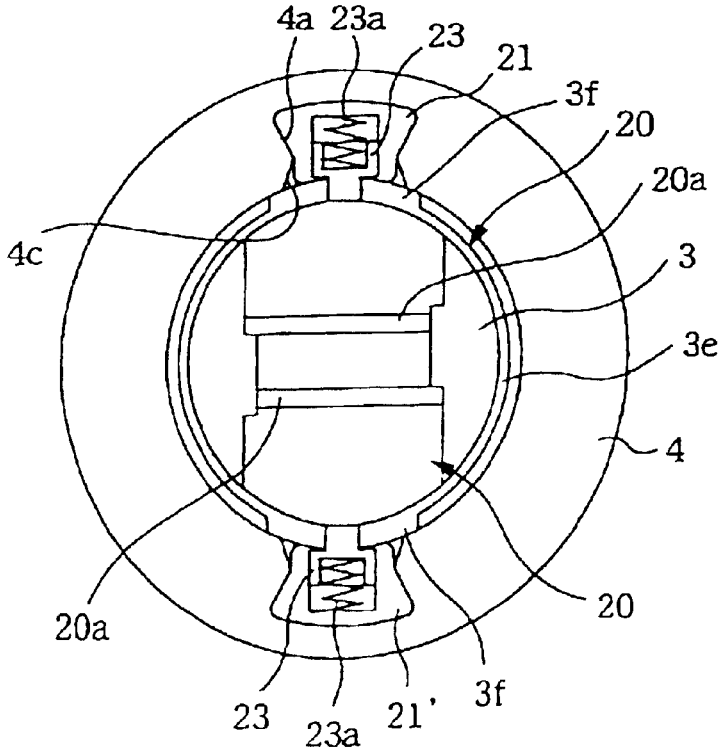
Figure 6A:
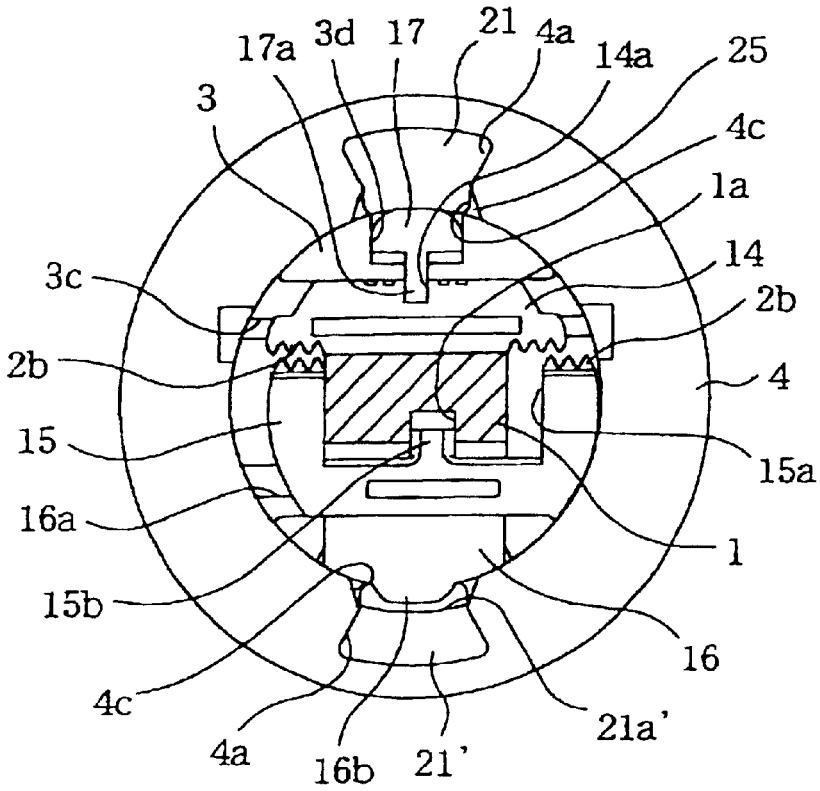
FIGS. 6A and 6B are views illustrating cross sections with the unlocking code setting key plate inserted, FIG. 6A being a view corresponding to FIG. 5A and FIG. 6B being a view corresponding to FIG. 5B.
Figure 6B:
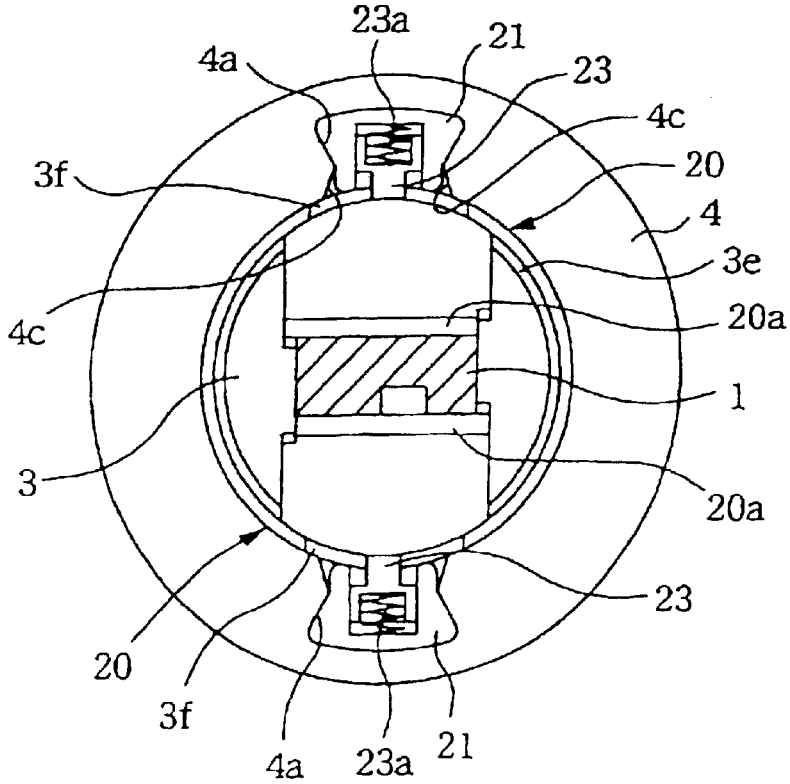

Further, the cylinder lock includes code setting portions 19 and detection portions 20 detecting the identification portion 5, described later, of the key plate 1 and driving the code setting portions 19. The code setting portions 19 comprise code setting bodies 21, 21' located in the cylinder case 4 to face the side bar 17 and the tumbler holding block 16; lock projections 17*b* formed in the side bar 17; and ride-over projections 16*b* formed in the tumbler holding block 16. The code setting bodies 21, 21' each have recesses 21*a*, 21*a*' to receive the projections 17*b*, 16*b* of the opposing side bar 17 or tumbler holding block 16 and are installed in setting body accommodating portions 4*a* provided in the cylinder case 4. The recesses 21*a* on the side of the side bar 17 cooperate with the setting body accommodating portion 4*a* to form the lock recess 25. Side walls 4*c* of the setting body accommodating portions 4*a* on the opening side are inclined so that the width of the setting body accommodating portions 4*a* progressively increases toward the inner circumference. Accordingly, even if the side bar 17 or tumbler holding block 16 projects from the rotor 3 into the setting body accommodating portions 4*a*, when a rotating force is applied to the rotor 3, the side bar 17 or tumbler holding block 16 is retracted into the rotor 3 by a component force generated by the inclined surface, thus releasing the rotation boundary surface between the side bar 17 or tumbler holding block 16 and the cylinder case 4. Further, as shown in FIG. 5, side walls 16*c* of the ride-over projections 16*b* of the tumbler holding block 16 are inclined so that the width of the ride-over projections 16*b* decreases toward the tip end. The lock projections 17*b* of the side bar 17 are also inclined to have a narrower width toward the tip end. Because of these arrangement, the rotating force applied to the rotor 3 is efficiently transformed into a component force acting in the retraction direction.

The code setting bodies 21, 21' are movable in the direction of the insertion axis c1 of the key plate 1 and are urged rearward by a drive spring 22 made from a compression spring. Further, the code setting bodies 21, 21' have a stopper pin (stopper) 23 at the rear end thereof engaged in a stopper groove 3*e* formed in the entire outer circumference of the rotor 3 to restrict the rearward movement of the code setting bodies 21, 21'. The stopper pin 23 is urged toward the rotor 3 by a stopper spring 23*a* formed of a compression spring, and a rear wall surface of the stopper groove 3*e* is increased in diameter in a predetermined range of angle including a range of advancement and retraction, described later, of the detection tumbler 20 to form stopper walls 3*f*.

The cylinder lock constructed as described above can maintain two states, one in which the cylinder lock assembly work is just finished (initial state) and one in which the unlocking code described later is set. In the initial state shown in FIG. 4 to FIG. 6B, the code setting bodies 21, 21' are restricted from moving backward by the stopper pin 23, with the lock projections 17*b* of the side bar 17 resting on push projections 21*b* formed between the recesses 21*a* of the code setting member 21. In this state, as shown in FIG. 5A, the side bar 17 is pressed down into the rotor 3, releasing the rotation boundary surface between the rotor 3 and the cylinder case 4, and the raised stopper strip 17*a* of the side bar 17 engages with the unlock enable notches 14*a* of the lock tumblers 14 to prevent the lock tumblers 14 from moving sideways.

Further, in the initial state, the ride-over projections 16*b* of the tumbler holding block 16 are opposed to the recesses 21*a*' of the code setting body 21' and, as shown in FIG. 5A, the tumbler holding block 16 can be moved beyond the rotation boundary surface between the rotor 3 and the cylinder case 4 to the cylinder case 4 side by engaging the ride-over projections 16*b* into the recesses 21*a*' of the code setting body 21'. The movement distance by which the tumbler holding block 16 projects from the rotor 3 is set larger than the meshing depth of the key-driven tumblers 15 and the lock tumblers 14. When the ride-over projections 16*b* of the tumbler holding block 16 come into the recesses 21*a*' of the code setting body 21', the key-driven tumblers 15 move together with the tumbler holding block 16 in a disengaging direction to disengage from the lock tumblers 14.

When the key plate 1 having an arbitrary unlocking code is inserted into the rotor 3, the engagement projection 15*b* of the key-driven tumbler 15 located at the front thereof firstly engages with the code forming groove 1*a* of the key plate 1, and sequentially, the key plate 1 is inserted into the key-driven tumbler 15 while receiving the engagement projections 15*b* in the code forming groove 1*a* so that the front opening portion of the code forming groove 1*a* is entered into the engagement projections 15*b* of the key-driven tumblers 15. In the initial state described above, because the key-driven tumblers 15 are disengaged from the lock tumblers 14 that are regulated from the sideway motion by engaging the unlock enable notches 14*a* with the raised stopper strip 17*a* of the side bar 17, the key-driven tumblers 15 move along the moving planes so as to follow the shape of the code forming groove 1*a* of the key plate 1, thereby allowing the key plate 1 to pass through. Even when the key-driven tumblers 15 are in mesh with the lock tumblers 14, the insertion force of the key plate 1 applies a sideway motion force to the key-driven tumblers 15, with the result that a component force generated at the contact portion with the motion-restricted lock tumblers 14 pushes the tumbler holding block 16 toward the recesses 21*a*' of the code setting body 21', disengaging the key-driven tumblers 15 from the lock tumblers 14. As a result, the key-driven tumblers 15 can be moved independently of the lock tumblers 14, allowing the key plate 1 to be inserted easily.

Further, in the initial state as described above, the rotation boundary surface on the side of the side bar 17 is opened at all times and the tumbler holding block 16 is allowed to move inwardly of the rotor 3. If the ride-over projections 16*b* fit into the recesses 21*a*' of the code setting body 21' to close the rotation boundary surface, the operation of rotating the rotor 3 causes the ride-over projections 16*b* to retract into the rotor 3, thereby opening the rotation boundary surface. Therefore, the rotor 3 can be rotated at all times whatever the unlocking code formed in the key plate 1 may be.

Figure 3A:
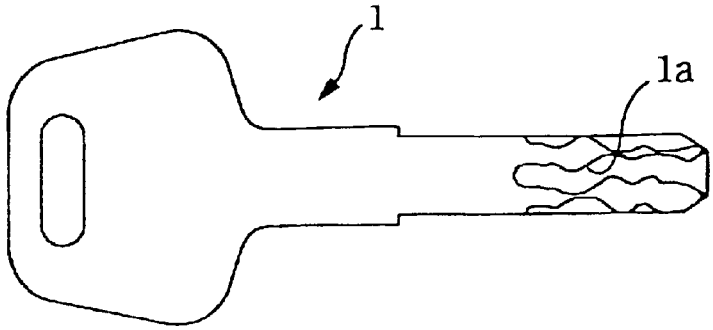
FIGS. 3A to 3F are views illustrating key plates.
Figure 3B:
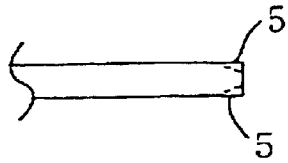

A transition from the initial state to the code setting state is effected by inserting the key plate 1 having the identification portion 5 into the rotor 3 and rotating the rotor 3 with the key plate 1. In this embodiment, the identification portion 5 is formed by using the thickness of the free end of the key plate 1 as shown in FIG. 3B, and detection tumblers forming the detection portions 20 are arranged in the rotor 3. The detection tumblers 20, as shown in FIG. 4, have guide inclined surfaces 20*a* at the end on the front side and are disposed opposite the stopper pins 23 of the code setting bodies 21, 21'. The detection tumblers 20 are pushed by the identification portion 5 in a direction away from the rotor 3 to move the stopper pins 23 in a direction that disengages them from the stopper groove 3*e*.

Figure 7A:
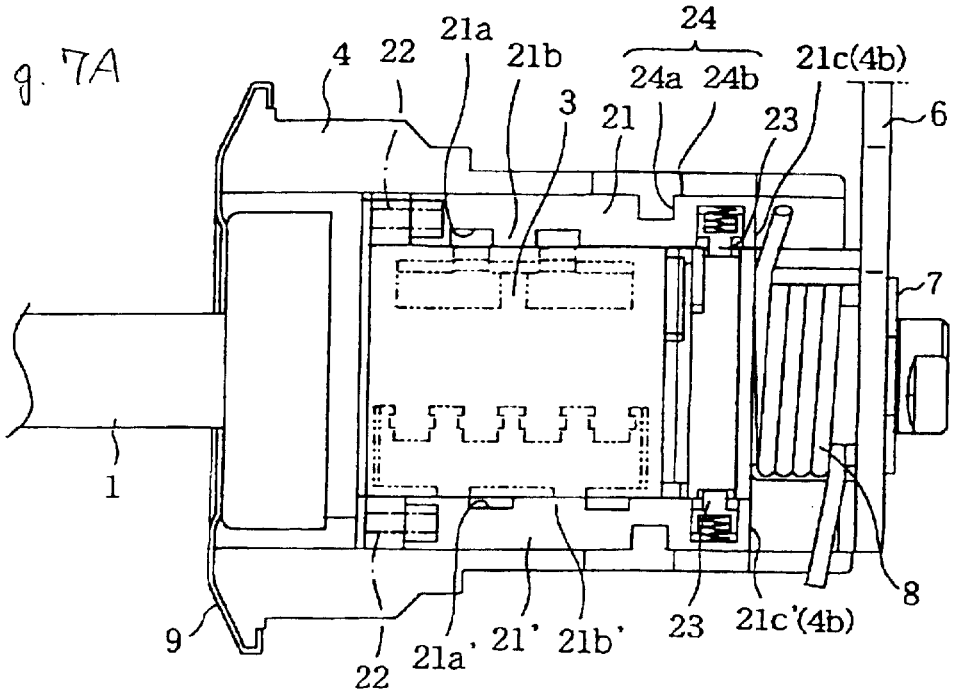
FIGS. 7A to 7C are views illustrating cross sections with the key plate rotated from FIGS. 6A and 6B, FIG. 7A being a view corresponding to FIG. 4, FIG. 7B being a view corresponding to FIG. 6A and FIG. 7C being a view corresponding to FIG. 6B.
Figure 7B:
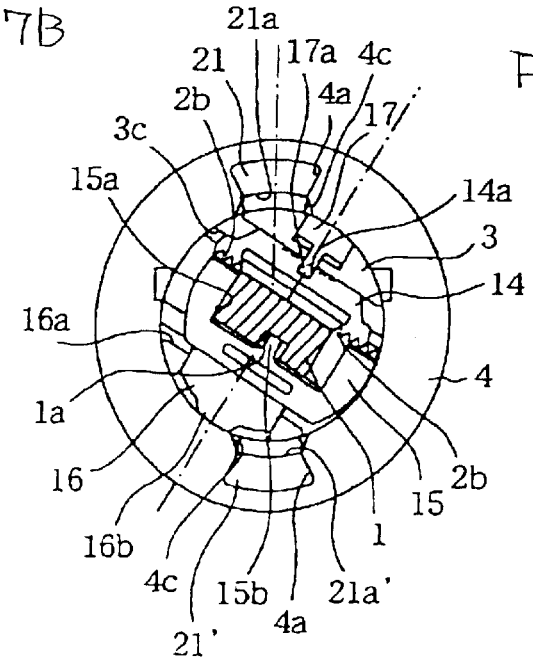
Figure 7C:
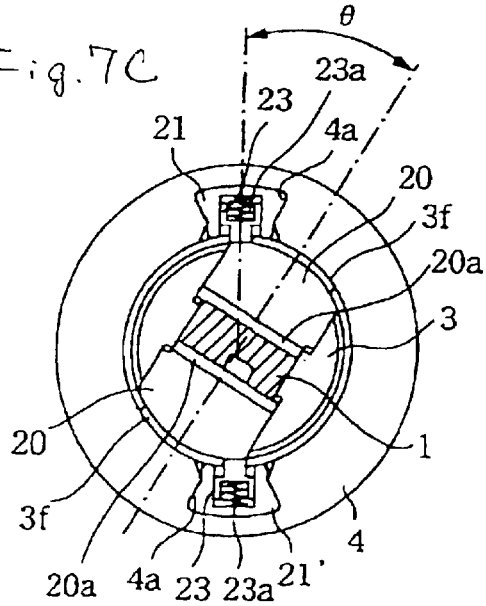

Then, when the rotor 3 is rotated, the tumbler holding block 16 is forcibly retracted into the rotor 3 by the inner wall of the cylinder case 4 and, at the same time, the key-driven tumblers 15 mesh with the lock tumblers 14, as shown in FIGS. 7A to 7C. In this state, the unlock enable notches 14*a* of the lock tumblers 14 are in engagement with the raised stopper strip 17*a* of the side bar 17 and the key-driven tumblers 15 are engaged in the code forming groove 1*a* of the inserted key plate 1 and already moved along the moving planes in the rotor 3 to their predetermined positions, so that the tumblers 2 form a lock-side unlocking code in one-to-one correspondence with an unlocking code of the inserted key plate 1. Further, when the rotor 3 is rotated through a predetermined angle (θ), the stopper pins 23 are disengaged from the stopper walls 3*f*, allowing the code setting bodies 21, 21' to be pushed rearward by the drive springs 22. As shown in FIGS. 7A to 7C and 9, at the end of the stroke of the code setting bodies 21, 21' where stopper notches 21*c*, 21*c*' at the rear end of the code setting bodies 21, 21' abut against stoppers 4*b* provided in the cylinder case 4, the lock projections 17*b* of the side bar 17 are opposed to the recesses 21*a* of the code setting body 21 and are brought into engagement with the recesses 21*a*, i.e., the lock recess 25, by the elastic recovery force of the leaf spring 18. With the side bar 17 moved into the cylinder case 4 side, the raised stopper strip 17*a* disengages from the unlock enable notches 14*a* of the lock tumblers 14, as shown in FIG. 8A, thus releasing the restraint of the lock tumblers 14.

Figure 9A:
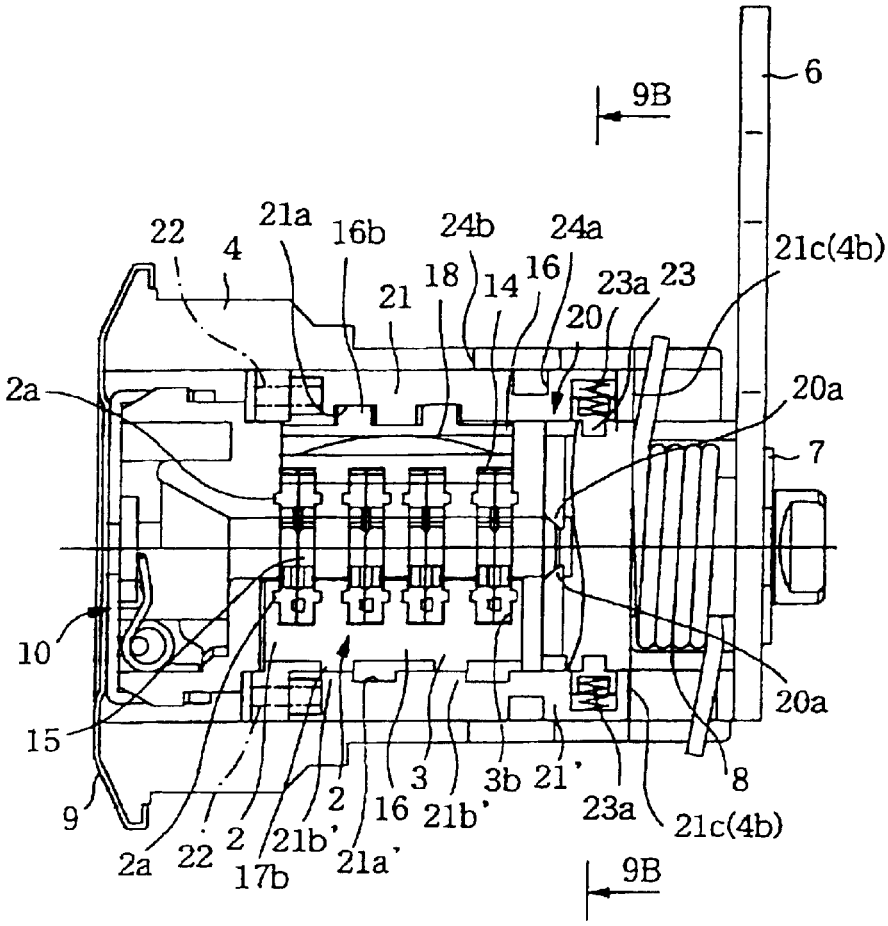
FIGS. 9A and 9B are views illustrating a state in which the unlocking code setting is completed, FIG. 9A being a view corresponding to FIG. 4 and FIG. 9B being a cross sectional view taken along the line 9B—9B of FIG. 9A.
Figure 9B:
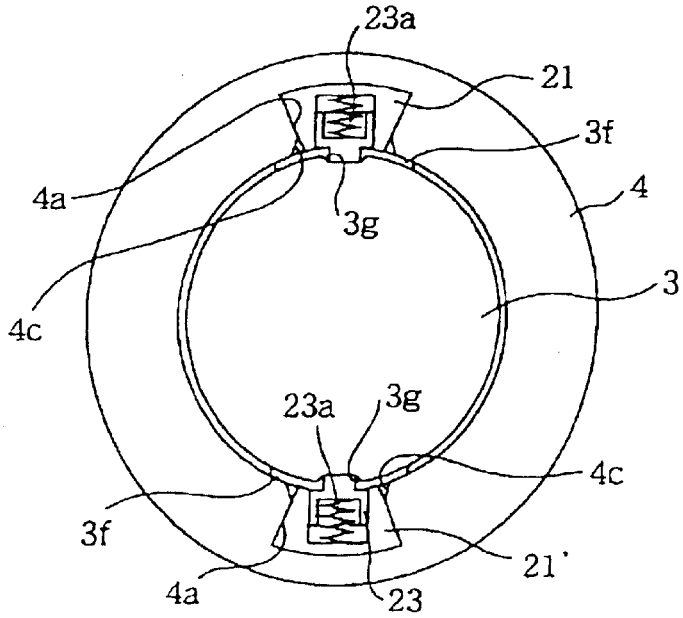
Figure 10:
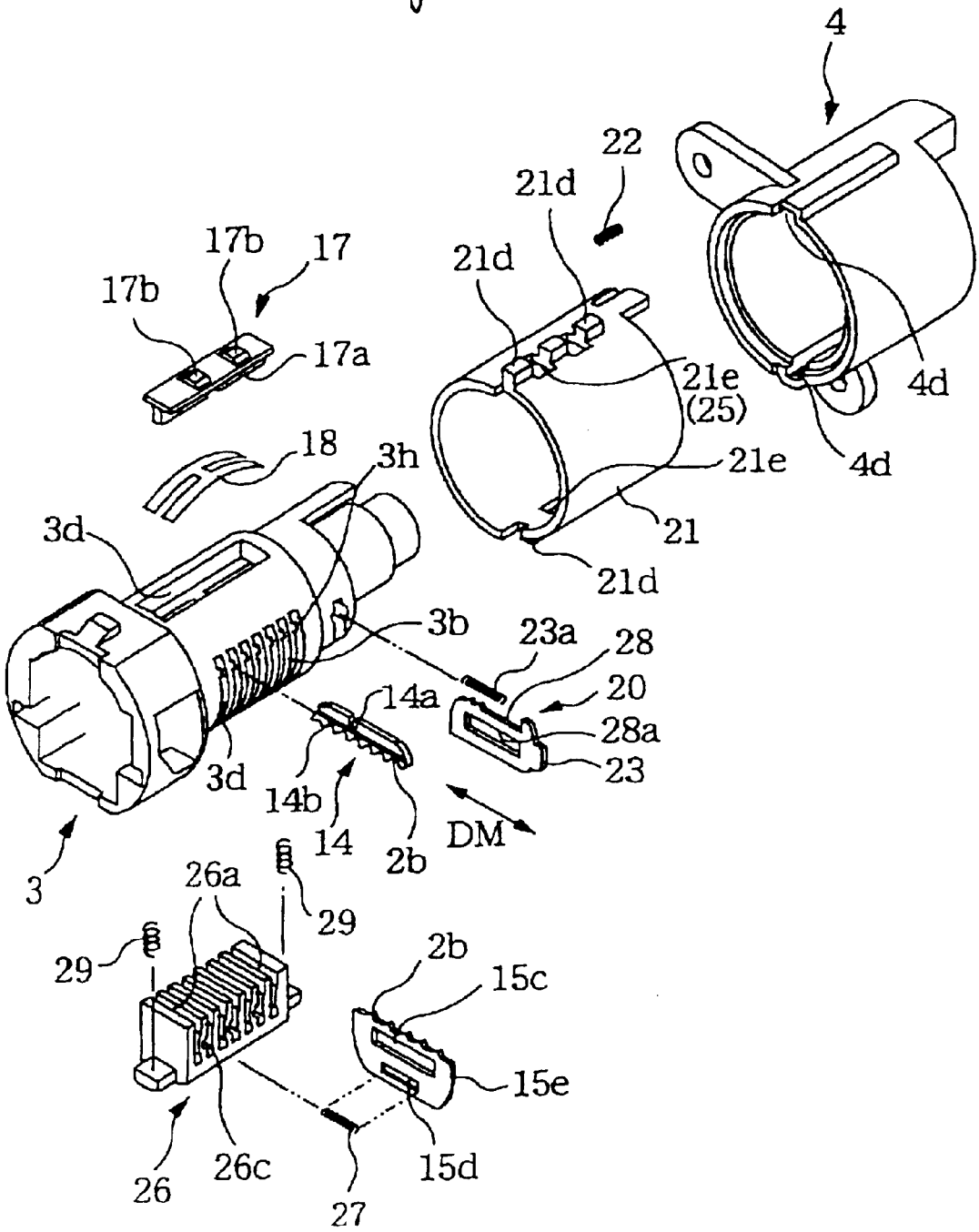
FIG. 10 is an exploded perspective view of a second embodiment of the invention.

Further, with the code setting bodies 21, 21' moved rearward, the stopper pins 23 sink in click recesses 3*g* of the rotor 3, as shown in FIG. 9A, to give a clicking feel when the rotor 3 is rotated to a position where the key plate 1 is inserted or withdrawn.

The movement of the code setting body 21' on the tumbler holding block 16 side based on the rotation of the rotor 3 causes the ride-over projections 16*b* of the tumbler holding block 16 to ride over the push projections 21*b*' formed between the recesses 21*a*' of the code setting body 21'. This prevents the tumbler holding block 16 from moving outwardly of the rotor 3 thereafter, thereby maintaining the engagement between the key-driven tumblers 15 and the lock tumblers 14.

Figure 3C:
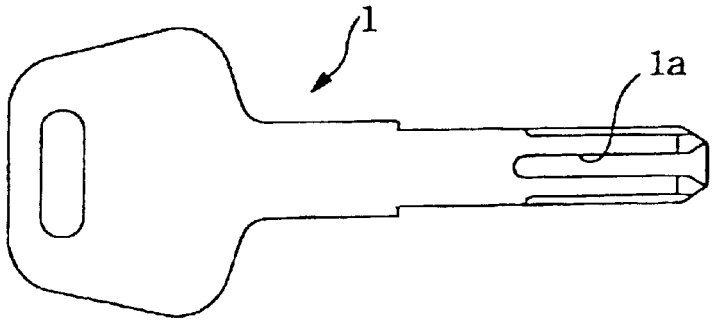
Figure 3D:
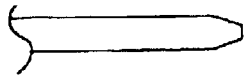
Figure 3E:
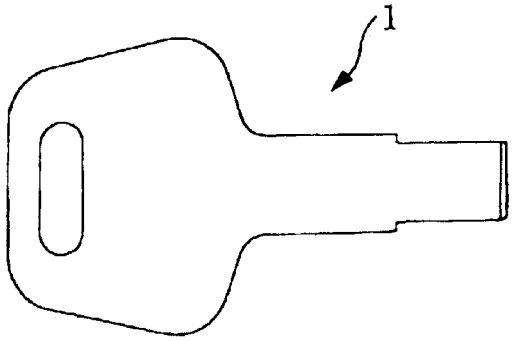
Figure 3F:
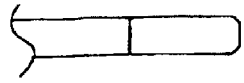

On the other hand, when a key plate 1 with its front end chamfered as shown in FIGS. 3C and 3D or too short to reach the detection tumblers 20 as shown in FIGS. 3E and 3F is inserted, the detection tumblers 20 are not operated, leaving the cylinder lock in its initial state. Also when the rotor 3 is stopped before the stopper pins 23 move beyond the stopper walls 3*f* and is then returned to the initial rotary position, the rotor 3 cannot be shifted out of the initial state because the code setting bodies 21, 21' cannot be moved back.

In the unlocking code setting state, when the key plate 1 is inserted to the normal position, the key-driven tumblers 15 are moved sideways on the moving planes to predetermined positions by the code forming groove 1*a* of the key plate 1 and the lock tumblers 14 in mesh with the key-driven tumblers 15 are also moved sideways on the moving planes together with the key-driven tumblers 15. If the unlocking code of the key plate 1 matches the lock-side unlocking code formed by the tumblers 2, the unlock enable notches 14*a* of the lock tumblers 14 are opposed to the raised stopper strip 17*a* of the side bar 17, as shown in FIG. 8A. When in this state a rotary operation force is applied to the rotor 3, the side wall 4*c* on the opening side of the setting body accommodating portion 4*a* applies to the side bar 17 a component of the rotary force directed to the inward of the rotor 3, causing the side bar 17 to sink into the rotor 3 with its raised stopper strip 17*a* engaging in the unlock enable notches 14*a* of the lock tumblers 14, whereby the rotor 3 is allowed to rotate.

On the other hand, when a key plate 1 other than the genuine key is inserted, the key-driven tumblers 15 are moved to positions other than the predetermined positions, so that the unlock enable notches 14*a* of the lock tumblers 14 do not face the raised stopper strip 17*a* of the side bar 17. As a result, the interference between the raised stopper strip 17*a* and the lock tumblers 14 prevents the side bar 17, which projects into the lock recess 25 to close the rotation boundary surface, from sinking into the rotor 3. The rotor 3 therefore cannot be rotated.

Further, this embodiment has an initial state recovery means 24. The initial state recovery means 24 has a hole-like driven portion 24*a* provided in each of the code setting bodies 21, 21' and an access hole 24*b* formed in the cylinder case 4. The access hole 24*b*, as shown in FIGS. 4 and 7A to 7C, is a slot which is elongate in the key plate insertion axis c1 and has such an enough size that, at the ends of the stroke of the code setting bodies 21, 21', the access hole 24*b* can face the driven portion 24*a* of the code setting bodies 21, 21'.

In the code setting state, the rotor 3 is rotated to open the paths for the stopper pins 23 closed by the stopper walls 3*f* and then the driven portions 24*a* of the code setting bodies 21, 21' are operated by a pin-like jig through the access holes 24*b* to move the code setting bodies 21, 21' forward, and then the rotor 3 is returned to the initial rotary position, whereby the code setting bodies 21, 21' are held at their initial positions and thereafter the cylinder lock is kept in the initial state.

In the above explanation, we have shown a case where the code forming portion 1*a* of the key plate 1 is formed as a groove in the side surface of the key plate 1. It may also be formed in the shape of notch in the cut end face. There are two code setting bodies 21, 21', one corresponding to the side bar 17 and the other to the tumbler holding block 16. They may be formed as one piece. Further, the direction of motion of the code setting bodies during the code setting process, i.e., the direction in which to urge them by the drive spring 22, may be reversed.

The above embodiment requires the use of a key plate 1 with the identification portion 5 in order to set the unlocking code. The lock-side unlocking code that matches the unlocking code of the inserted key plate 1 by rotating the rotor 3 may be formed regardless of the presence or absence of the identification portion 5. For this structure, in the above embodiment for example, the only modification required is to disengage the stopper pins 23 from the stopper groove 3*e* by inserting the key plate 1. The stopper pins 23 function as a detector to detect the full insertion of the key plate 1.

A second embodiment of this invention is shown in FIGS. 10 through 16. In the following description of this and subsequent embodiments, the constitutional elements essentially identical with those of the first embodiment are given like reference numbers and their explanations are omitted.

Figure 13A:
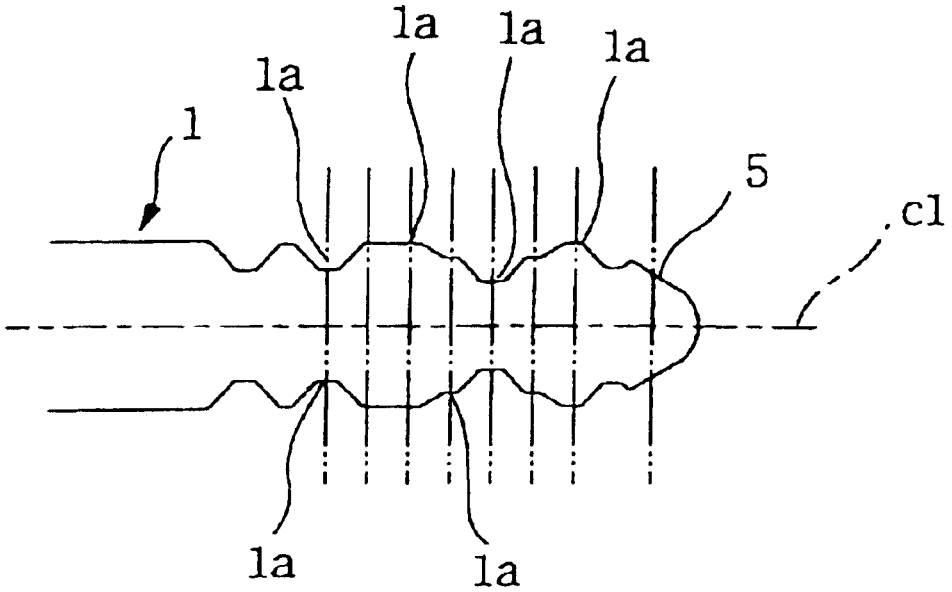
FIGS. 13A and 13B are views illustrating key plates, FIG. 13A being a plan view of a key plate with an identification portion and FIG. 13B being a plan view without an identification portion.

In this embodiment, the side surfaces of the key plate 1 are formed with a plurality of code forming notches with differing depths at a pitch that matches the arrangement pitch of the tumblers 2 in the rotor 3, as shown in FIG. 13A. These notches form code forming portions 1*a*.

Lock tumblers 14 each have a guide groove 14*b* in the surface and have an unlock enable notch 14*a* and meshing projections 2*b* in the side wall portions. The lock tumblers 14 are inserted into the tumbler grooves 3*b* in the rotor 3. To hold the lock tumblers 14 movable only in the main moving direction (DM), the tumbler grooves 3*b* of the rotor 3 are provided with guide projected strips 3*h* that slidably fit in the guide grooves 14*b*. A stopper tumbler 28 that serves as a stopper 23 and a detector 20 is mounted at the terminal end of the rotor 3. The stopper tumbler 28 has a key insertion hole 28*a* of a narrow rectangular shape at the center and is urged to move out of the rotor 3 by a stopper spring 23*a*.

Key-driven tumblers 15 each have a key insertion hole 15*c* of a narrow rectangular shape at the center through which the key plate 1 can be inserted, and also a spring accommodating hole 15*d* formed by the side of the key insertion hole 15*c*. The key-driven tumblers 15 also have meshing projections 2*b* formed in the side wall portion thereof, that engage the meshing projections 2*b* of the lock tumblers 14. The key-driven tumblers 15 have a longitudinally extending guide groove 15*e* on the surface thereof.

Reference numeral 26 is a tumbler guide block which is installed in the rotor 3 so as to be movable in a direction perpendicular to the main moving direction (DM). The tumbler guide block 26 is urged to move out of the rotor 3 by block urging springs 29. The tumbler guide block 26 has a plurality of tumbler holding grooves 26*a*, 26*a*, . . . at a pitch that matches the pitch at which the tumbler grooves 3*b* are formed in the rotor 3. Guide projected strips 26*b* that can engage in the guide grooves 15*e* of the key-driven tumblers 15 are formed on the wall surfaces of the tumbler holding grooves 26*a*, so that the key-driven tumblers 15 in the rotor 3 can be held slidable in the main moving direction (DM).

The tumbler guide block 26 has bottomed spring holding holes 26*c* at positions overlapping the tumbler holding grooves 26*a*. Tumbler springs 27 made from compression springs are accommodated in the spring holding holes 26*c*. The tumbler springs 27 fitted in the spring accommodating holes 15*d* of the key-driven tumblers 15 contact at one end the bottom walls of the spring holding holes 26*c* and, at the other end, the circumferential wall of the spring accommodating holes 15*d* to urge the key-driven tumblers 15 to move out of the rotor 3. The spring holding holes 26*c* are formed so that the directions of their openings are reversed alternately, which urges the key-driven tumblers 15 in alternately opposite directions.

Further, the tumbler guide block 26 is also formed with ride-over projections 26*d*, as with the tumbler holding block 16 described the above, whose width decreases toward the end.

The rotor 3 holding the tumbler guide block 26 on one side thereof and the side bar 17 on the opposite side is inserted into a movable sleeve (code setting body 21). The movable sleeve 21 is cylindrically formed and accommodated in the cylinder case 4 so that it is longitudinally slidable with its guide projection 21*d* formed on the outer circumferential wall fitted into a guide recess 4*d*. A drive spring 22 is installed in the cylinder case 4 to urge the movable sleeve 21 toward the front. The movable sleeve 21 has engagement openings 21*e* formed at longitudinally appropriate locations, which can receive the ride-over projections 26*d* of the tumbler guide block 26 and the lock projections 17*b* of the side bar 17. The engagement openings 21*e* corresponding to the lock projections 17*b* constitute the lock recesses 25. The lock projections 17*b*, the ride-over projections 26*d* and the engagement openings 21*e* have a positional relationship such that when the engagement openings 21*e* on either side of the tumbler guide block 26 or the side bar 17 are in an engaged state, the engagement openings 21*e* on the other side are disengaged.

Figure 11A:
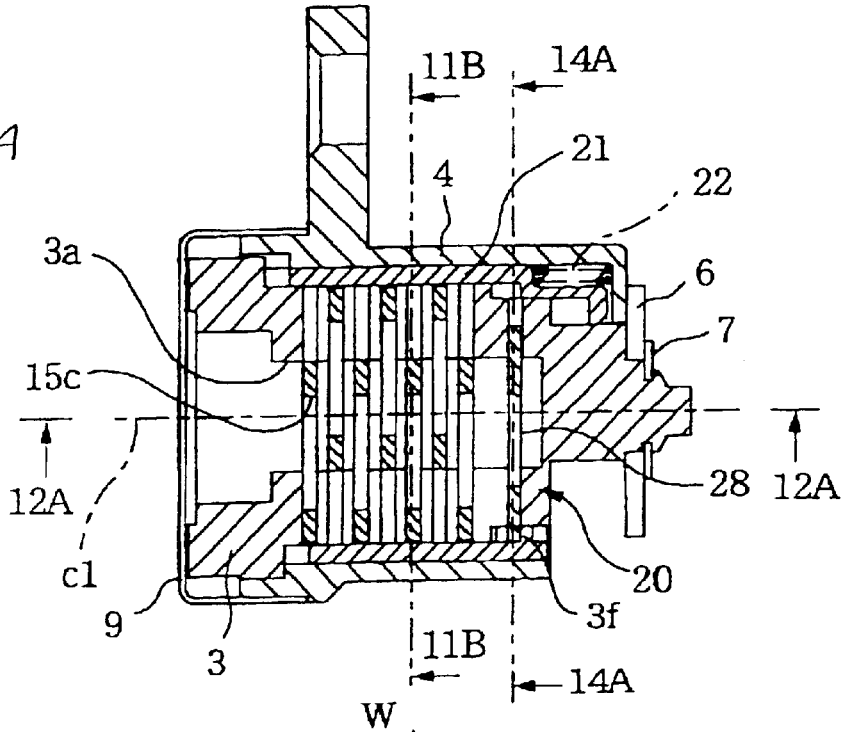
FIGS. 11A and 11B are views illustrating an initial state, FIG. 11A being a vertical cross sectional view and FIG. 11B being a cross sectional view taken along the line 11B—11B of FIG. 11A.
Figure 11B:
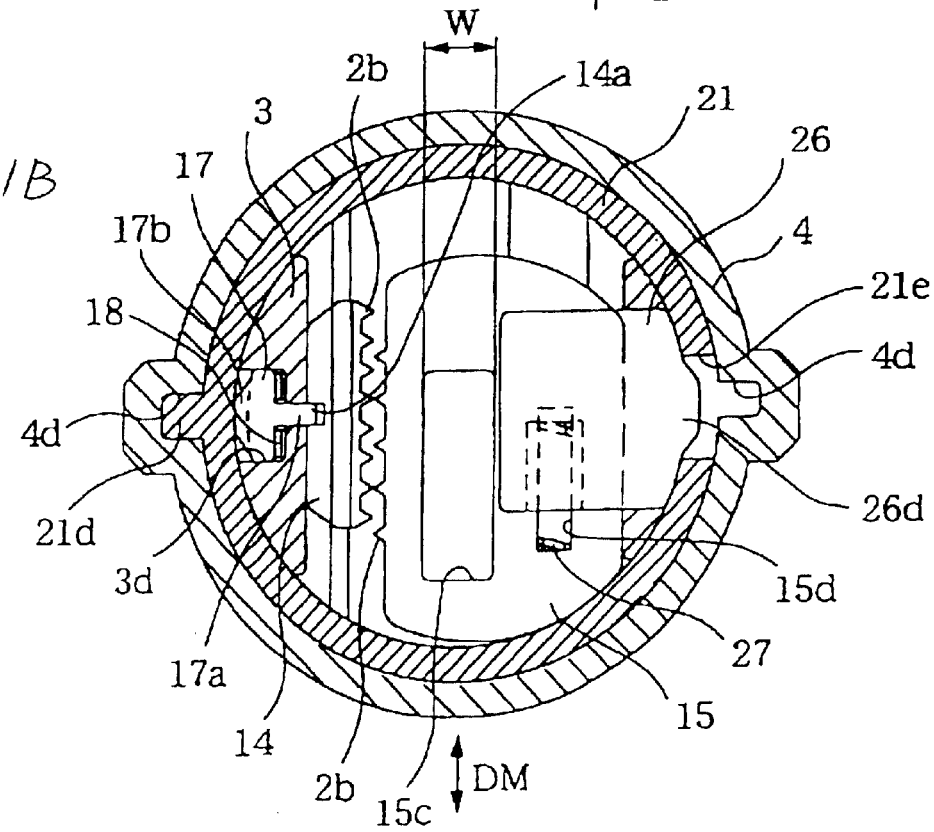
Figure 12:
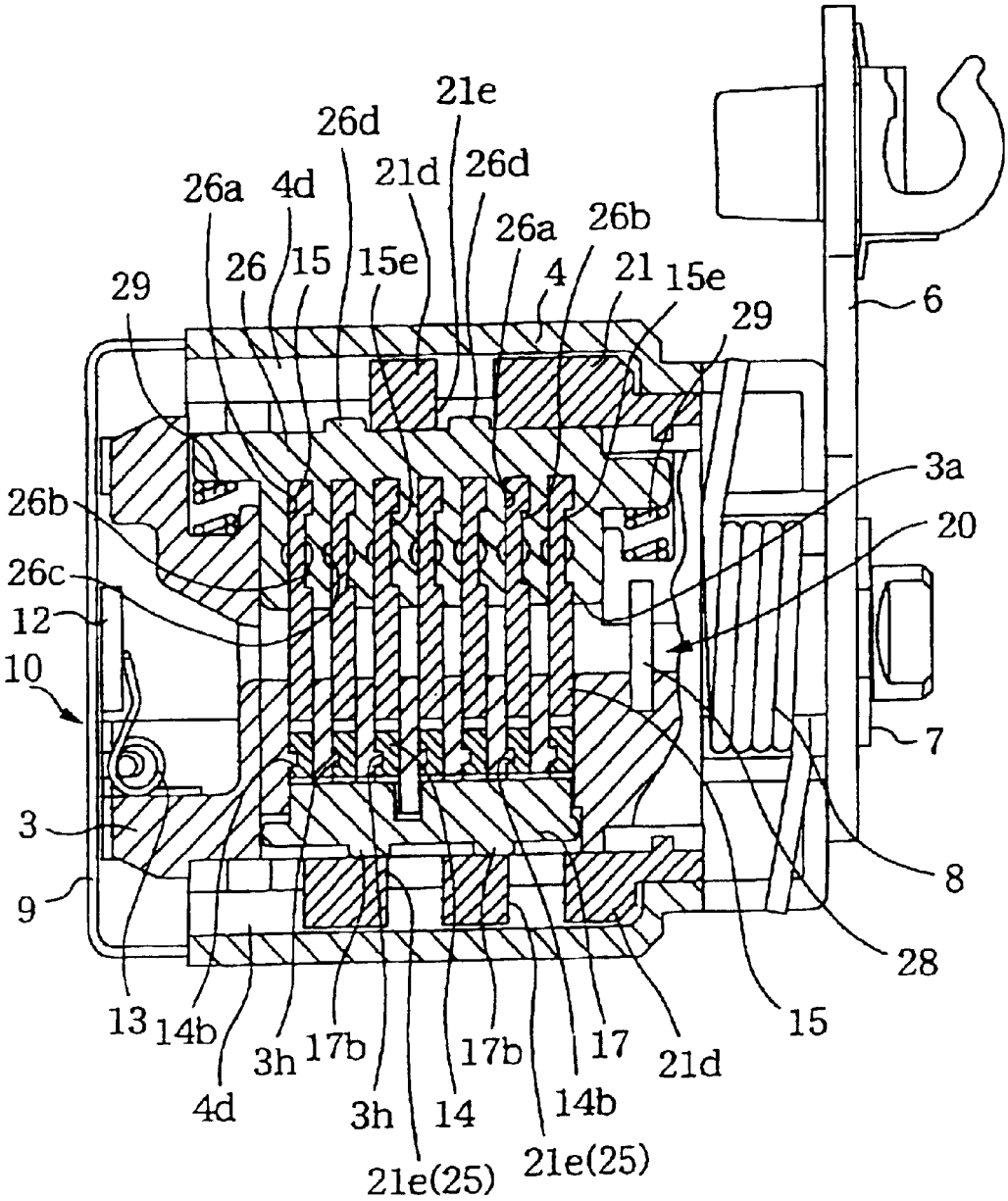
FIG. 12 is a cross-section view taken along the line 12A—12A of FIG. 11A.

In this embodiment, therefore, in the initial state, the movable sleeve 21 is kept at the rear position by holding the stopper wall 3*f* formed on the movable sleeve 21 against the stopper tumbler 28 of the rotor 3, as shown in FIGS. 11A to 12. At the same time, the tumbler guide block 26 is urged to move out of the rotor 3 by the block urging springs 29 so that the ride-over projections 26*d* fit into the engagement openings 21*e*. In this state, the key-driven tumblers 15 held in the tumbler guide block 26 and the lock tumblers 14 held in the rotor 3 are kept in a disengaged state (see FIG. 11B). The lock projections 17*b* of the side bar 17 do not match the engagement openings 21*e* but contact the inner circumferential wall of the movable sleeve 21 and remain inside the rotor 3. In this state, the raised stopper strip 17*a* of the side bar 17 engages the unlock enable notches 14*a* of the lock tumblers 14 to restrict the movement of the lock tumblers 14.

Even when the key insertion hole 15*c* of each of the key-driven tumblers 15 is in the state as shown, i.e., at a position shifted with respect to the key plate insertion axis c1 by an engagement allowance distance of the ride-over projections 26*d*, the key insertion hole 15*c* has a width (w) enough to receive the key plate 1. Hence, the rotor 3 can be rotated whatever kind of the code forming portion 1*a* is formed in the key plate 1, as in the first embodiment.

In this embodiment, as shown in FIG. 13A, introductory inclination surfaces formed at the terminal end of the key plate 1 is used as the identification portion 5. When the key plate 1 with the identification portion 5 is inserted into the rotor 3, the key-driven tumblers 15 are moved to positions corresponding to the depths of the code forming groove 1*a* of the key plate 1 and kept there by the recovery force of the tumbler springs 27. By inserting the key plate 1 to the insertion stroke end, the introductory inclined surface 5 of the key plate 1 pushes the circumferential wall of the key insertion hole 28*a* of the stopper tumbler 28, which is in the initial state of FIG. 14A, to move it inwardly of the rotor 3 and thereby reduce the dimension of engagement between the stopper tumbler 28 and the stopper wall 3*f* of the movable sleeve 21.

Next, when the rotor 3 is rotated by the key plate 1, the ride-over projections 26*d* of the tumbler guide block 26 come out of the engagement openings 21*e* and are pressed against the inner circumferential wall surface of the movable sleeve 21, moving the tumbler guide block 26 and the key-driven tumblers 15 toward the center of the rotor 3 and bringing the key-driven tumblers 15 into engagement with the lock tumblers 14. As a result, the lock tumblers 14 and the key-driven tumblers 15 move as one piece.

Figure 14A:
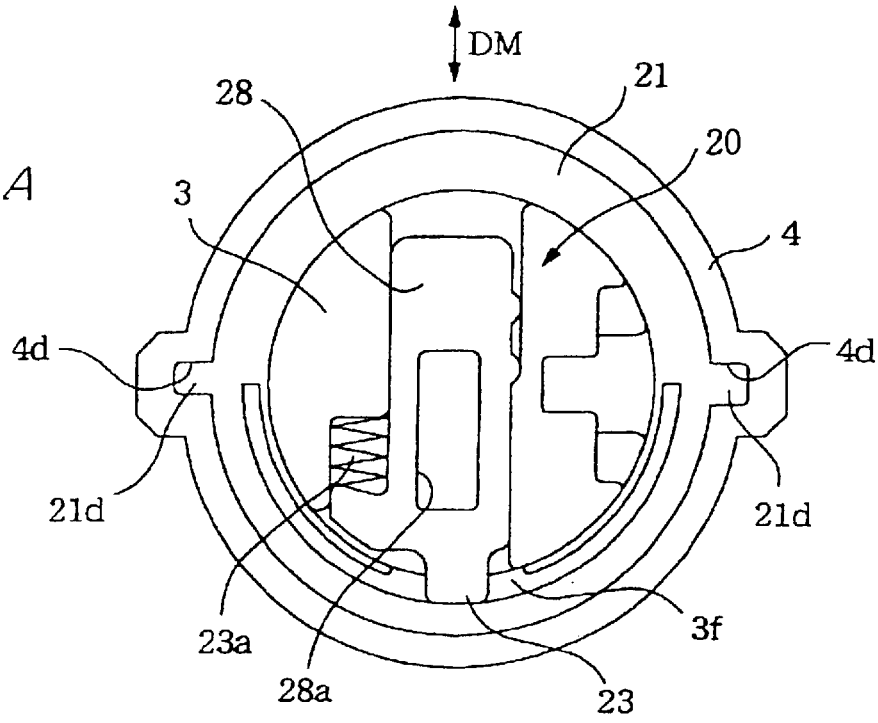
FIGS. 14A and 14B are views illustrating an operation of a detection portion, FIG. 14A being a cross section view taken along the line 14A—14A of FIG. 11A with the detection portion in an initial state and FIG. 14B being a cross sectional view taken along the line 14A—14A of FIG. 11A with the detection portion operated.
Figure 14B:
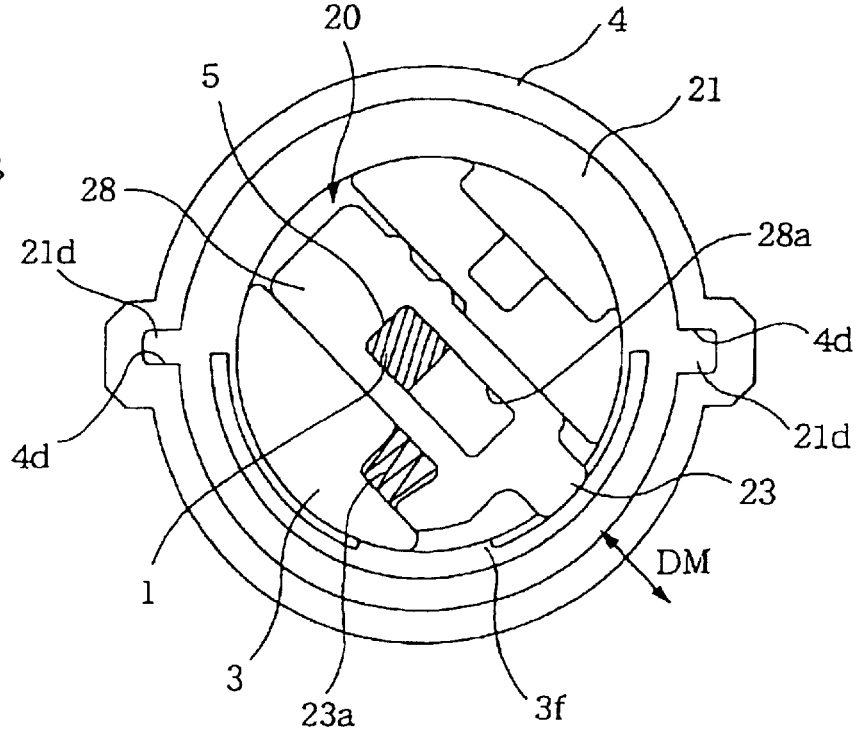

The engaged state of the stopper wall 3*f* and the stopper tumbler 28 is maintained until the rotor 3, i.e., the stopper tumbler 28, rotates through a predetermined angle, after which they are disengaged as shown in FIG. 14B. After being disengaged from the stopper tumbler 28, the movable sleeve 21 moves to the forward stroke end position by the recovery force of the drive spring 22.

Figure 15A:
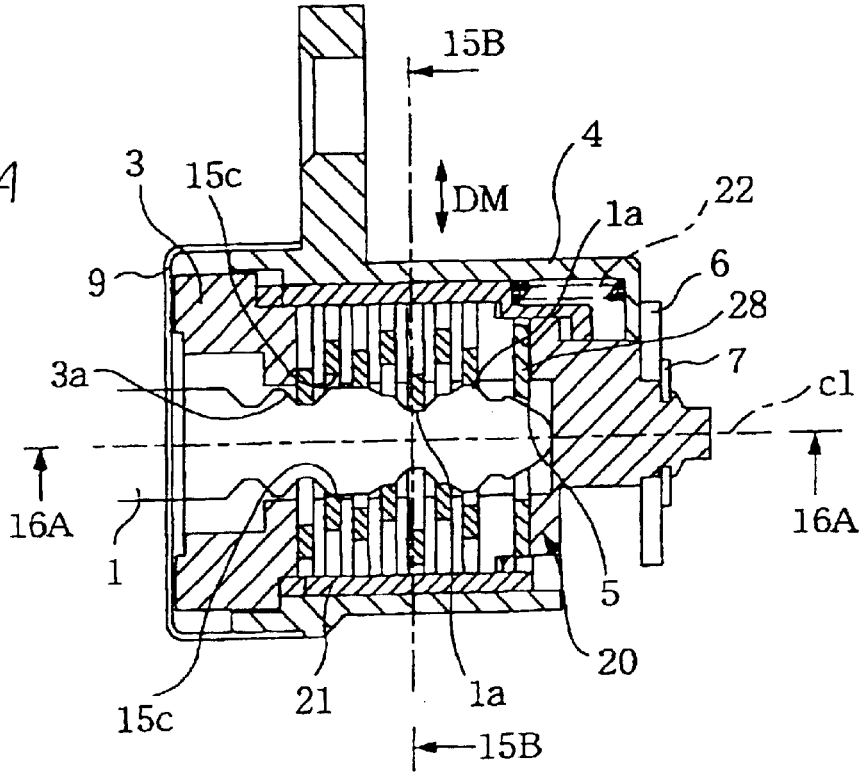
FIGS. 15A and 15B are cross sectional views of a cylinder lock after the lock-side unlocking code has been formed, FIG. 15A being a vertical cross sectional view and FIG. 15B being a cross section view taken along the line 15B—15B of FIG. 15A.
Figure 15B:
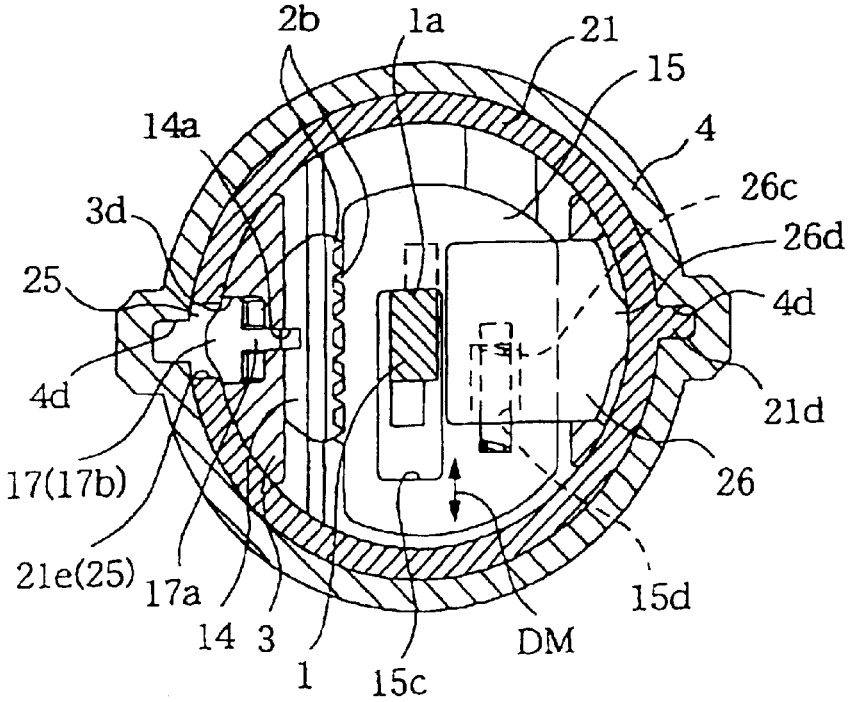
Figure 16:
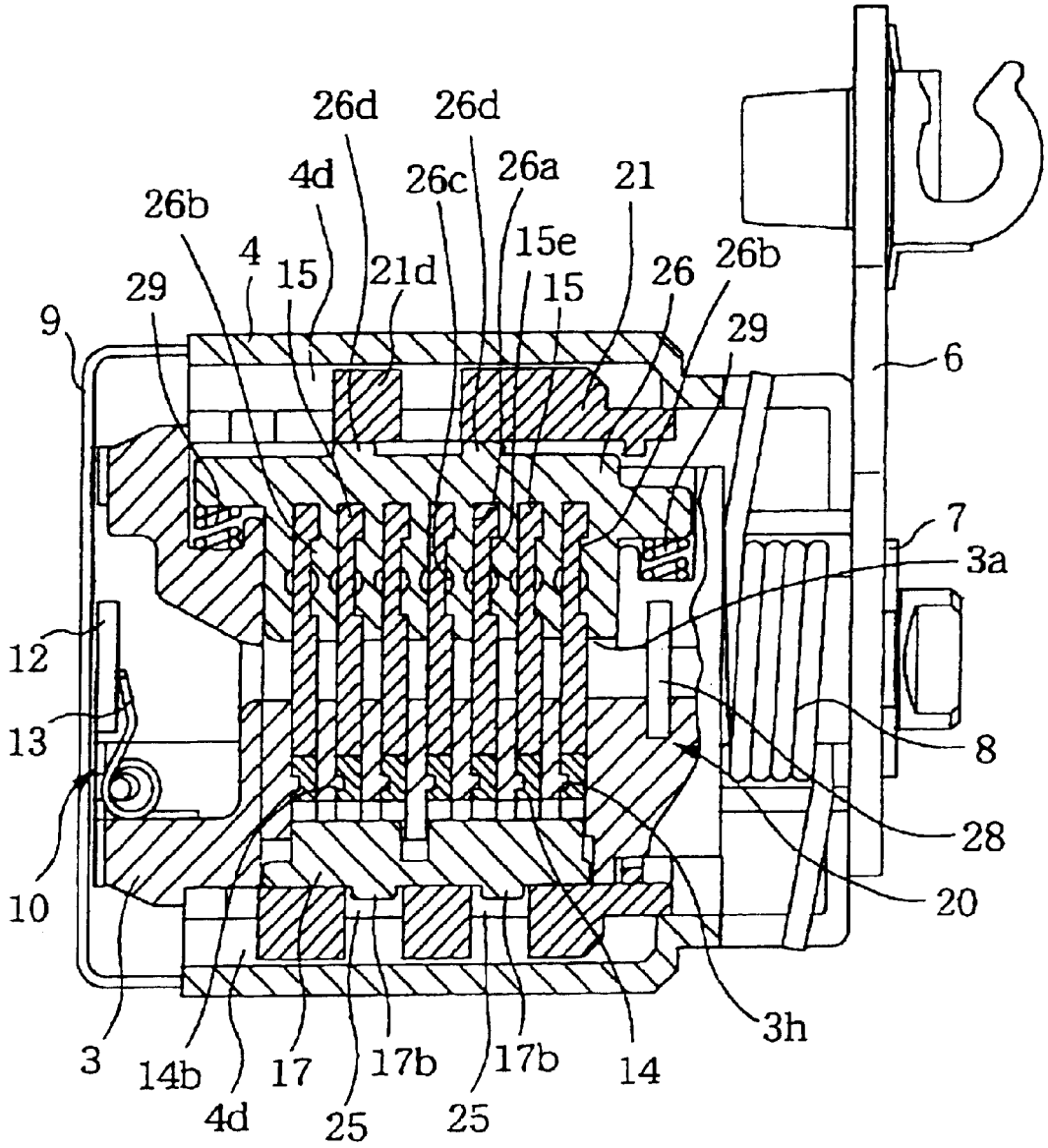
FIG. 16 is a cross-section view taken along the line 16A—16A of FIG. 15A.

Next, when the rotor 3 is rotated to the original position by the key plate 1, the lock projections 17*b* of the side bar 17 that has moved to the forward stroke end position now faces the engagement openings 21*e* of the movable sleeve 21 and, as shown in FIG. 15B, fit into the engagement openings 21*e* of the movable sleeve 21. In this state, the raised stopper strip 17*a* of the side bar 17 is disengaged from the unlock enable notches 14*a* of the lock tumblers 14, leaving the lock tumblers 14 free to move. After this, the lock tumblers 14 can be moved together with the key-driven tumblers 15 with which the lock tumblers 14 are integrated through the meshing projections 2*b*. Then, when the key plate 1 is withdrawn from the rotor 3, with the lock projections 17*b* of the side bar 17 located to match the engagement openings 21*e*, the ride-over projections 26*d* of the tumbler guide block 26 engage the inner circumferential wall of the movable sleeve 21 and thus prevent the key-driven tumblers 15 from moving in a direction that disengages them from the lock tumblers 14. Therefore, the key-driven tumblers 15 at the positions corresponding to the code forming notches 1*a* of the key plate 1 undisengageably meshes with the lock tumblers 14 and they move as one piece.

Then, when a key plate 1 with a different kind of unlocking code is inserted, the key-driven tumblers 15 that correspond to the code forming notches 1*a* with different depths are shifted together with the lock tumblers 14 from the predetermined positions in the rotor 3 and thus the unlock enable notches 14*a* of the lock tumblers 14 are also shifted from the positions facing the raised stopper strip 17*a* of the side bar 17. As a result, the side bar 17 cannot be retracted into the rotor 3, thereby preventing the rotation of the rotor 3.

Figure 13B:
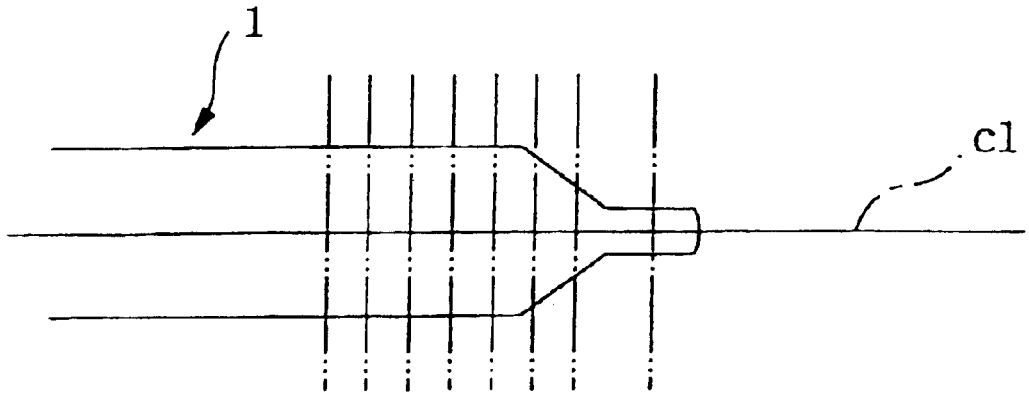

When a key plate 1 with no identification portion 5 of FIG. 13B is inserted into the rotor 3 in the initial state, the stopper tumbler 28 does not move inwardly of the rotor 3, which means that the movable sleeve 21 does not move forward, thus maintaining the initial state.

In this embodiment, too, the code that has already been set can be restored to the initial state by rotating the rotor 3 with a genuine key plate 1 to a position where the stopper tumbler 28 does not interfere with the stopper wall 3*f* of the movable sleeve 21 and then moving the movable sleeve 21 to the rear stroke end using an appropriate jig.

A third embodiment of this invention is shown in FIGS. 17A to 20. In this embodiment, the key-driven tumblers 15 each have a U-shaped insertion recess 15*a* and are movably installed in the rotor 3 and urged by a tumbler spring 27 to move out of the rotor 3. The lock tumblers 14 installed in the rotor 3 each have a V-shaped unlock enable notch 14*a* with a pair of opposing inclined sides 14*c*, 14*c* and are guided in a direction perpendicular to the main moving direction (DM).

The side bar 17 has a V-shaped raised stopper strip 17*a* at one edge that can engage the inclined sides 14*c* of the unlock enable notches 14*a*. The side bar 17 is held in a code setting body 21 that is movable in a longitudinal direction of the cylinder case 4, the side bar 17 can be moved in a direction perpendicular to the main moving direction (DM). A bar drive spring 30 made from a compression spring is interposed between the side bar 17 and the code setting body 21, and the side bar drive spring 30 urges the side bar 17 toward the center of the rotor 3. To limit the distance by which the side bar 17 projects into the rotor 3, there are provided side bar stoppers 31 in the side bar 17 and the code setting body 21. The inner circumferential wall of the cylinder case 4 is formed with a lock recess 25 to allow the side bar 17 to move out of the rotor 3.

The code setting body 21 is movable in a direction perpendicular to the main moving direction (DM) and is urged longitudinally rearwardly of the rotor 3 by a drive spring 22 interposed between the rotor 3 and the code setting body 21. The outer circumferential wall surface of the code setting body 21 is formed with ride-over projections 21*f* that can fit in an engagement recess 4*e* formed in the inner circumferential wall of the cylinder case 4.

Figure 17A:
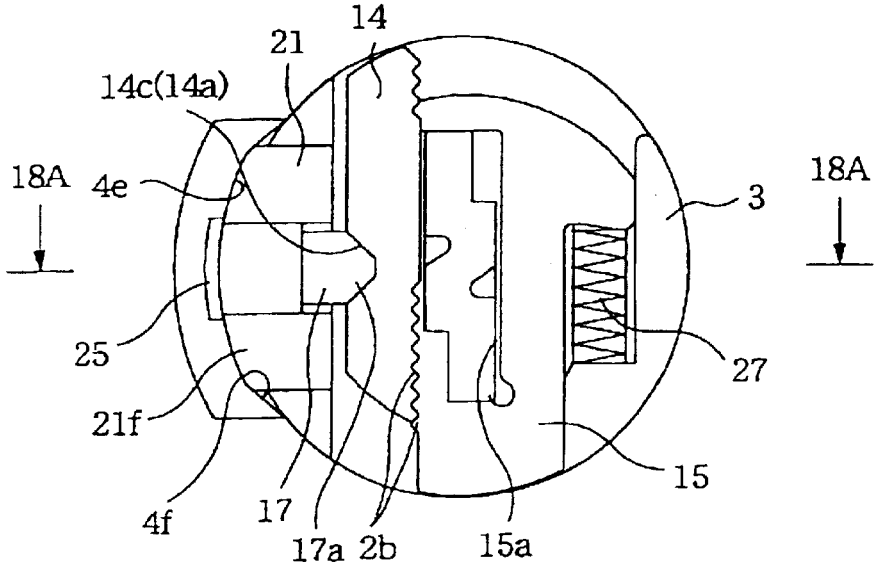
FIGS. 17A and 17B are views illustrating a third embodiment of the invention, FIG. 17A being a cross sectional view in an initial state and FIG. 17B being a cross section view after the lock-side unlocking code has been formed.
Figure 18A:
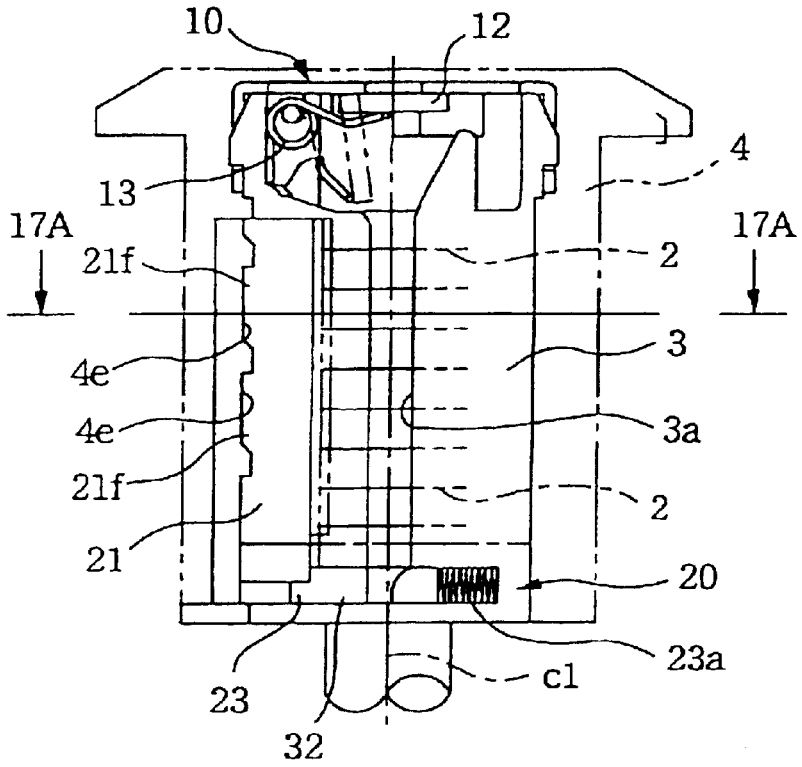
FIGS. 18A and 18B are cross sectional views of FIGS. 17A and 17B, FIG. 18A being a cross section view taken along the line 18A—18A of FIG. 17A and FIG. 17B being a cross section view taken along the line 18B—18B of FIG. 17B.

In this embodiment, in the initial state, the code setting body 21 remains at a forward position with its terminal end engaging a stopper plate 32 that serves as a stopper 23 and a detection portion 20, both provided at the terminal end of the rotor 3, as shown in FIG. 18A. In this state, the side bar 17 is pressed inwardly of the rotor 3 by the side bar drive spring 30 to urge the lock tumblers 14, whose unlock enable notches 14*a* receive the raised stopper strip 17*a*, toward the key-driven tumblers 15, thereby engaging them together, as shown in FIG. 17A. At the same time, the side bar drive spring 30 urges the code setting body 21 toward the outside of the rotor 3 to fit the ride-over projections 21*f* into the engagement recess 4*e* of the cylinder case 4 which the ride-over projections 21*f* oppose in the initial state.

The lock tumblers 14 can be moved in a direction that disengages them from the key-driven tumblers 15 because the code setting body 21 projects into the cylinder case 4. When a key plate 1 without an identification portion 5 as shown in FIG. 13B is inserted, the key-driven tumblers 15 change their meshing positions with respect to the lock tumblers 14 and move to positions in the rotor 3 corresponding to the depths of the code forming notches 1*a* of the key plate 1. When applied with an operation force against the urging force of the side bar drive spring 30, the code setting body 21 can move inwardly of the rotor 3. When, with the key plate 1 inserted, a rotating force is applied to the rotor 3, an inclined surface 4*f* of the engagement recess 4*e* of the cylinder case 4 applies to the code setting body 21 a pressing force acting inwardly of the rotor 3 to cause the code setting body 21 to sink into the rotor 3, so that the rotor 3 can be rotated without being influenced by the unlocking code of the key plate 1.

Figure 19:
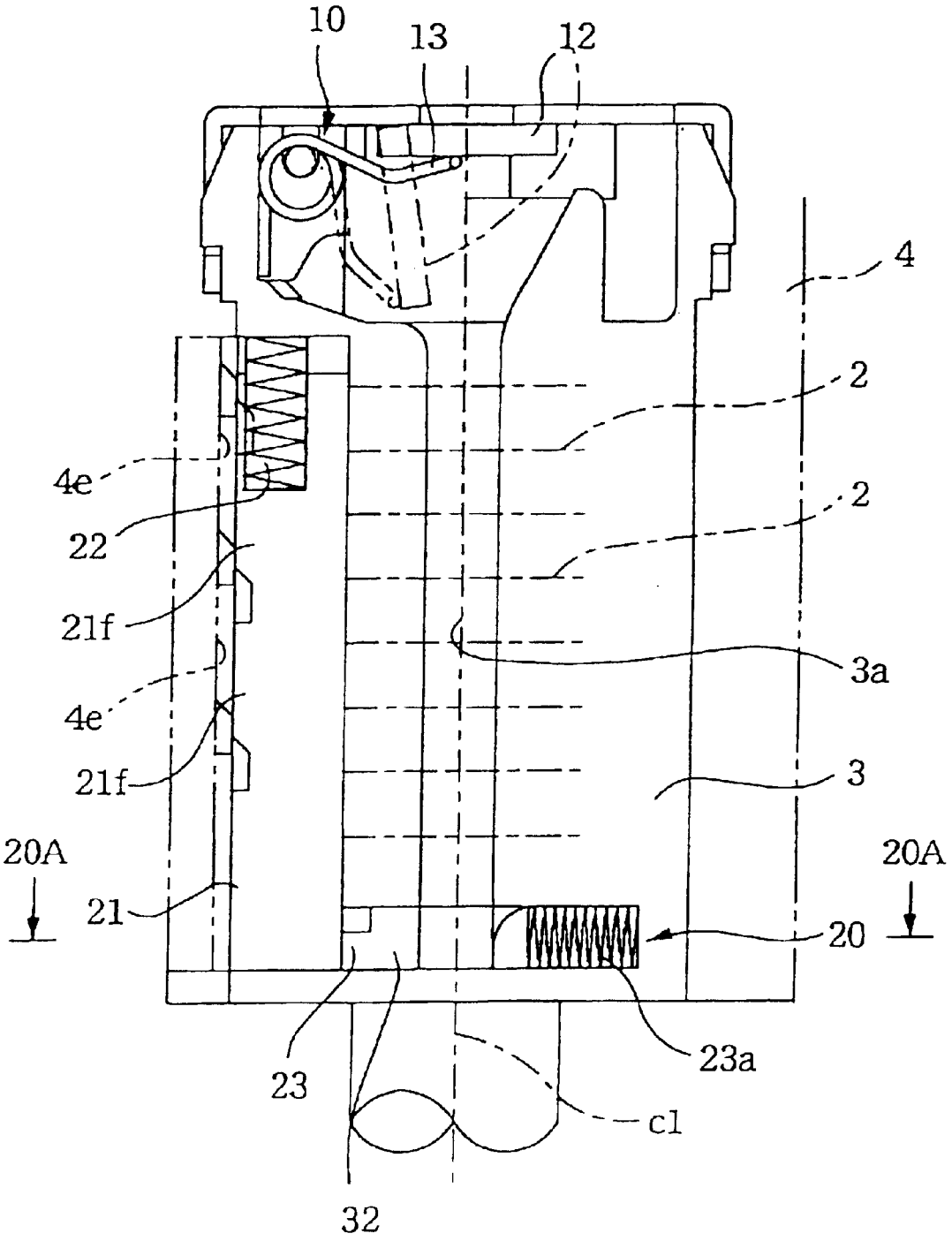
FIG. 19 is a vertical cross sectional view with the detection portion operated.
Figure 20:
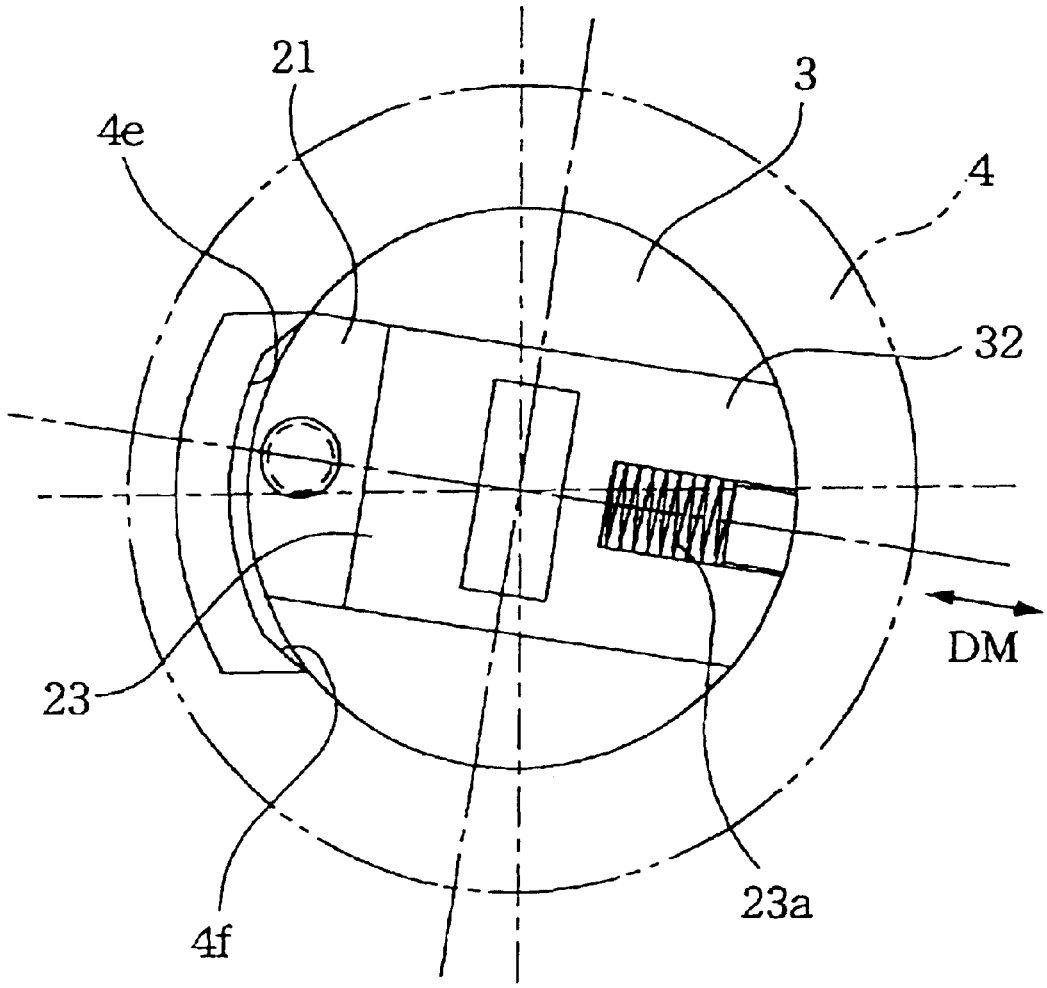
FIG. 20 is a cross sectional view taken along the line 20A—20A of FIG. 19.

When on the other hand a key plate 1 with an identification portion 5 is inserted, the identification portion 5 causes the stopper plate 32 of the rotor 3 to move inwardly of the rotor 3 against the force of the stopper spring 23*a*, reducing the dimension of its engagement with the code setting body 21. After this, upon rotating the rotor 3 to a predetermined angle, the code setting body 21 is completely disengaged from the stopper plate 32 (see FIG. 20). As shown in FIG. 19, the code setting body 21, because it is disengaged from the stopper plate 32, is moved rearward by the drive spring 22. The rearward motion of the code setting body 21 breaks the matching relation between the ride-over projections 21*f* of the code setting body 21 and the engagement recess 4*e* of the cylinder case 4, causing the ride-over projections 21*f* of the code setting body 21 to ride over the inner circumferential wall of the cylinder case 4 and remain at their positions inside the rotor 3. To ensure that the ride-over projections 21*f* move smoothly by the recovery force of the side bar drive spring 30, the wall surfaces of the ride-over projections 21*f* and the engagement recess 4*e* are inclined in a direction of motion of the code setting body 21.

The movement of the code setting body 21 into the rotor 3 restricts the motion of the lock tumblers 14 in a direction that disengages them from the key-driven tumblers 15. The lock tumblers 14 thereafter are only allowed to move together with the key-driven tumblers 15.

Figure 17B:
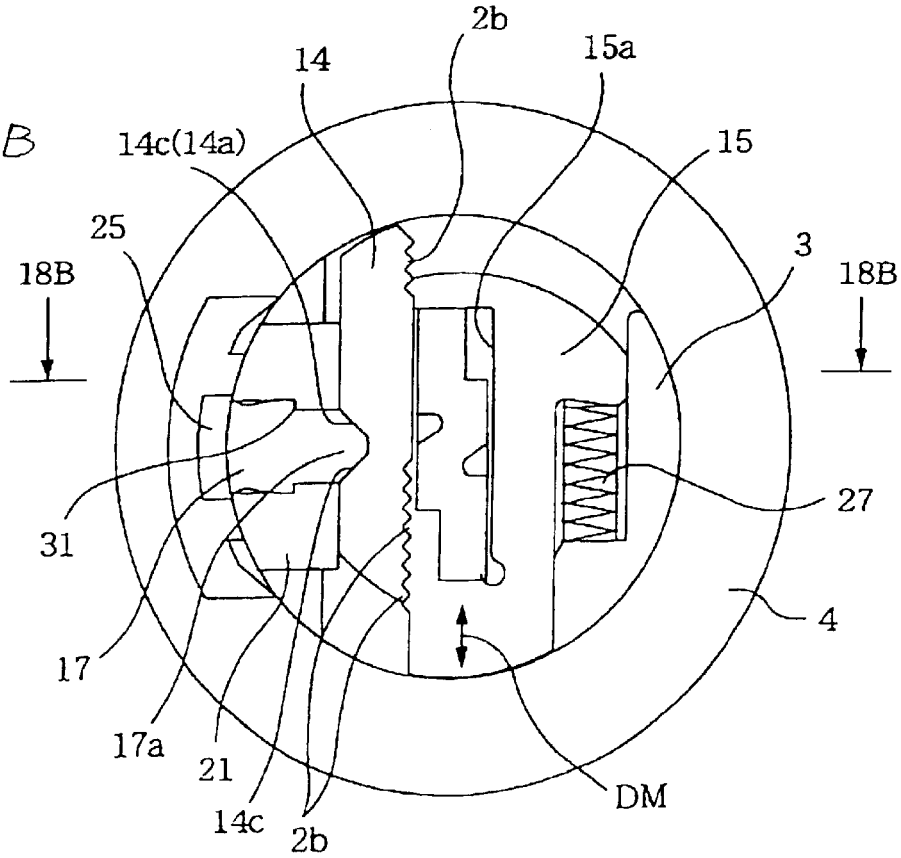
Figure 18B:
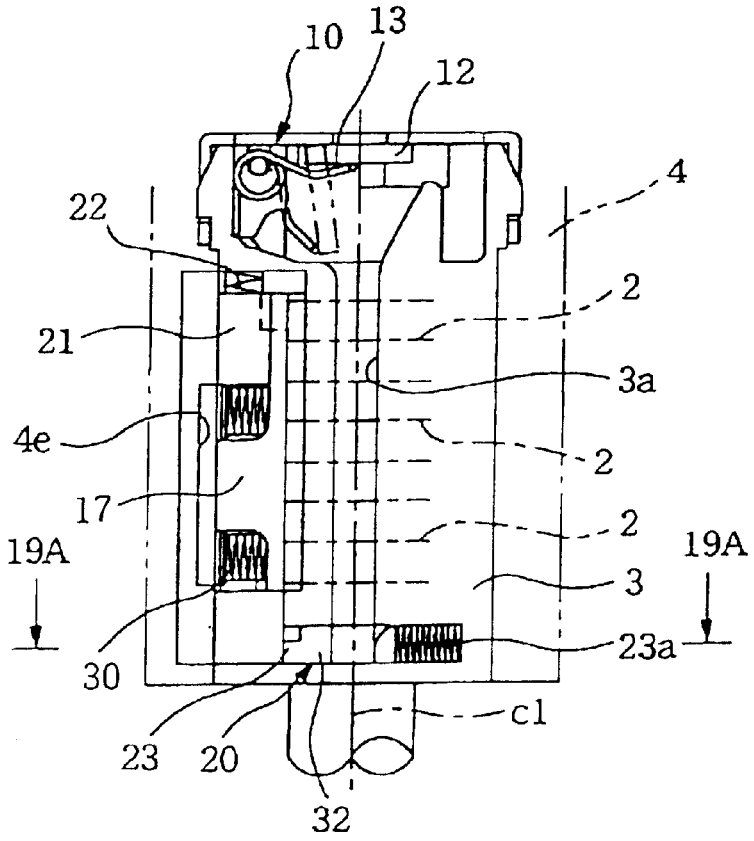

Next, when the rotor 3 is returned to the original position and the key plate 1 is pulled out, the code setting is completed as shown in FIG. 17B and FIG. 18B. When in this state a key plate 1 of a different kind is inserted, because the positions of the key-driven tumblers 15 differ from the positions they assumed when the code was set, the side bar 17 is pushed out of the rotor 3 by the inclined sides 14*c* of the lock tumblers 14. As a result, one end of the side bar 17 engages in the lock recess 25 of the cylinder case 4, closing the rotation boundary surface of the rotor 3 and thereby preventing the rotation of the rotor 3. When the key plate 1 that was used to set the code is inserted, the side bar 17 is accommodated in the rotor 3, releasing the rotation boundary surface of the rotor 3 and allowing the rotor 3 to be rotated.

INDUSTRIAL APPLICABILITY

As can be seen from the foregoing description, the present invention allows the unlocking code to be set at any desired time after the cylinder lock has been assembled. Further, because the rotating operation of the rotor can be done before the unlocking code is set, the efficiency of the automotive assembly work can be improved. Moreover, because a plurality of cylinder locks with the same tumbler construction can be manufactured, the manufacturing efficiency is also improved.

What is claimed is:

1. A cylinder lock, comprising a rotor in which tumblers are installed, wherein the rotor is rotatably inserted in a cylinder case, wherein the cylinder lock initially does not include any lock-side unlocking code, and the cylinder lock is configured to receive an inserted key plate, and wherein in response to an identification portion formed in the inserted key plate, the tumblers are configured to follow a code forming portion of the inserted key plate to form a particular lock-side unlocking code, wherein the particular lock-side unlocking code matches a key-side unlocking code defined by the code forming portion of the inserted key plate, such that after the formation of the particular lock-side unlocking code, the inserted key comprises a use key configured to unlock the cylinder lock.

2. The cylinder lock according to claim 1, wherein the rotor is rotatable with respect to the cylinder case before the particular lock-side unlocking code is formed.

3. The cylinder lock according to claim 1 or 2, wherein the tumblers form the particular lock-side unlocking code in response to the rotation of the rotor.

4. The cylinder lock according to claim 1 or 2, wherein the tumblers are operable to restore from the state where the particular lock-side unlocking code is formed to a state before the particular lock-side unlocking code is formed.

5. A cylinder lock comprising:

key-driven tumblers having their main moving directions in a plane perpendicular to a direction of insertion of a key plate inserted in a rotor, the key-driven tumbler being moved in the main moving directions to predetermined positions in the rotor in accordance with a code forming portion of the inserted key plate;

lock tumblers engageable with the key-driven tumblers at appropriate positions in the main moving direction;

a locking body moving in a direction crossing the main moving direction to advance into or retract from a lock recess on the cylinder case side, the locking body being enabled or disabled to retract from an advanced position in the lock recess according to the positions of the lock tumblers in the main moving direction so as to close or release a rotation boundary surface of the rotor;

a code setting body to keep the lock tumblers and the key-driven tumblers in an undisengageably meshed state, wherein the cylinder lock initially does not include any lock-side unlocking code and when the key plate is inserted into the cylinder lock that does not include the any lock-side unlocking code, a particular lock-side unlocking code that matches a key-side unlocking code of the inserted key plate is formed by operating the code setting body while maintaining the positions in the main moving direction of the lock tumblers that enable the retraction of the locking body into the rotor; and a detector capable of detecting an identification portion formed in the key plate, wherein when the identification portion is detected by the detector, an operation of forming the particular lock-side unlocking code is started, and when the operation of forming the particular lock-side unlocking code is complete, the inserted key plate comprises a use key configured to unlock the cylinder lock.

6. A cylinder lock comprising:

key-driven tumblers having their main moving directions in a plane perpendicular to a direction of insertion of a key plate inserted in a rotor, the key-driven tumbler being moved in the main moving directions to predetermined positions in the rotor in accordance with a code forming portion of the inserted key plate;

lock tumblers engageable with the key-driven tumblers at appropriate positions in the main moving direction;

a locking body moving in a direction crossing the main moving direction to advance into or retract from a lock recess on the cylinder case side, the locking body being enabled or disabled to retract from an advanced position in the lock recess according to the positions of the lock tumblers in the main moving direction so as to close or release a rotation boundary surface of the rotor, the locking body restricting the movement of the lock tumblers in the main moving direction at the retracted position from the lock recess;

a tumbler holding block movable in a direction perpendicular to the main moving direction between a meshed position maintaining a meshing of the lock tumblers with the key-driven tumblers and an unmeshed position releasing from the meshing thereof; and a code setting body, when an identification portion formed in the key plate is detected, allowing the locking body to move into the lock recess and at the same time moving to a position where it prevents the tumbler holding block from moving from the meshed position to the unmeshed position, wherein the cylinder lock initially does not include any lock-side unlocking code, and wherein when the key plate is inserted into the cylinder lock that does not include the any lock-side unlocking code, a particular lock-side unlocking code matching a key-side unlocking code of the key plate inserted into the rotor is formed by the key plate having the identification portion, such that after the particular lock-side unlocking code is formed, the key plate comprises a use key configured to unlock the cylinder lock.

7. A cylinder lock comprising:

key-driven tumblers having their main moving directions in a plane perpendicular to a direction of insertion of a key plate inserted in a rotor, the key-driven tumbler being moved in the main moving directions to predetermined positions in the rotor in accordance with a code forming portion of the inserted key plate;

lock tumblers engageable with the key-driven tumblers at appropriate positions in the main moving direction; and a locking body moving in a direction crossing the main moving direction to advance into or retract from a lock recess on the cylinder case side, the locking body being enabled or disabled to retract from an advanced position in the lock recess according to the positions of the lock tumblers in the main moving direction so as to close or release a rotation boundary surface of the rotor, wherein the key-driven tumblers are held in a tumbler guide block in which they are urged in the main moving direction, the tumbler guide block being mounted in the rotor in such a manner that it is movable in a direction that engages the key-driven tumblers with the lock tumblers and urged in a direction that disengages the key-driven tumblers from the lock tumblers;

wherein locking body is urged to advance into the lock recess;

wherein cylinder lock initially does not include any lock-side unlocking code, and when the key plate is inserted into the cylinder lock that does not include the any lock-side unlocking code, a particular lock-side unlocking code that matches a key-side unlocking code of the inserted key plate is formed by maintaining the lock tumblers at positions in the main moving direction that allow the locking body to retract into the rotor and moving the tumbler guide block in a direction that engages the key-driven tumblers with the lock tumblers to bring the lock tumblers and the key-driven tumblers into undisengageable mesh with each other, such that after the particular lock-side unlocking code is formed, the key plate comprises a use key configured to unlock the cylinder lock.

8. The cylinder lock according to claim 7, wherein in the initial state the lock tumblers are held at positions in the main moving direction that allow the locking body to retract into the rotor and, before the particular lock-side unlocking code is formed, any key plate permits the rotor to be rotated.

9. A cylinder lock comprising:

key-driven tumblers having their main moving directions in a plane perpendicular to a direction of insertion of a key plate inserted in a rotor, the key-driven tumbler being moved in the main moving directions to predetermined positions in the rotor in accordance with a code forming portion of the inserted key plate;

lock tumblers engageable with the key-driven tumblers at appropriate positions in the main moving direction; and a locking body moving in a direction crossing the main moving direction to advance into or retract from a lock recess on the cylinder case side, the locking body being enabled or disabled to retract from an advanced position in the lock recess according to the positions of the lock tumblers in the main moving direction, wherein the key-driven tumblers are urged in the main moving direction by tumbler springs arranged in the rotor, wherein the lock tumblers are pushed by the locking body toward the key-driven tumblers to engage them with the key-driven tumblers in such a manner that they can change their meshing positions in the main moving direction, wherein the cylinder lock initially does not include any lock-side unlocking code, a when the key plate is inserted into the cylinder lock that does not include the any lock-side unlocking code, a particular lock-side unlocking code that matches a key-side unlocking code of the inserted key plate is formed by maintaining the lock tumblers at the positions in the main moving direction that enable the retraction of the locking body into the rotor and preventing the lock tumblers from moving in a disengaging direction to hold the lock tumblers and the key-driven tumblers in undisengageable mesh with each other, such that after the particular lock-side unlocking code is formed, the key plate comprises a use key configured to unlock the cylinder lock.

10. The cylinder lock according to claim 5, 7, 8 or 9, further including:

a code setting body which is movable in a key plate insertion direction and which has along its movement direction a disengagement disable position that prevents either of the tumblers from moving in the disengaging direction to disable the disengagement of the tumblers and a disengagement enable position that enables the disengagement between the lock tumblers and the key-driven tumblers;

wherein the code setting body held at the disengagement enable position in the initial state is moved to the disengagement disable position to form the particular lock-side unlocking code.

11. The cylinder lock according to claim 10, further including:

a drive spring urging the code setting body toward the disengagement disable position; and a stopper locking and maintaining the code setting body at the disengagement enable position;

wherein the stopper is released to allow the code setting body to be moved to the disengagement disable position by the recovery force of the drive spring to form the particular lock-side unlocking code.

12. The cylinder lock according to claim 11, wherein the stopper is accommodated in the rotor in such a manner as to be urged toward the outside of the rotor and be movable in the main moving direction, wherein an insertion of a key plate causes the stopper to retract into the rotor, disengaging it from the code setting body.

13. The cylinder lock according to claim 11, wherein the stopper is accommodated in the rotor in such a manner as to be urged toward the outside of the rotor and be movable in a main moving direction and when a key plate is inserted, the stopper being movable inwardly of the rotor, wherein, after the key plate is inserted and the rotor is rotated at a predetermined angle, the stopper is disengaged from the code setting body.

14. The cylinder lock according to claim 11, wherein the stopper is operated by an identification portion formed in the key plate.

15. A cylinder lock comprising:

key-driven tumblers having their main moving directions in a plane perpendicular to a direction of insertion of a key plate inserted in a rotor, the key-driven tumbler being moved in the main moving directions to predetermined positions in the rotor in accordance with a code forming portion of the inserted key plate;

lock tumblers engageable with the key-driven tumblers at appropriate positions in the main moving direction;

a locking body moving in a direction crossing the main moving direction to advance into or retract from a lock recess on the cylinder case side, the locking body being enabled or disabled to retract from an advanced position in the lock recess according to the positions of the lock tumblers in the main moving direction;

a code setting body which is movable in a key plate insertion direction and which has along its movement direction a disengagement disable position that prevents either of the tumblers from moving in the disengaging direction to disable the disengagement of the tumblers and a disengagement enable position that enables the disengagement between the lock tumblers and the key-driven tumblers;

a drive spring urging the code setting body toward the disengagement disable position; and a stopper locking and maintaining the code setting body at the disengagement enable position, wherein the key-driven tumblers are urged in the main moving direction by tumbler springs arranged in the rotor, wherein the lock tumblers are pushed by the locking body toward the key-driven tumblers to engage them with the key-driven tumblers in such a manner that they can change their meshing positions in the main moving direction, wherein the cylinder lock initially does not include any lock-side unlocking code, and when the key plate is inserted Into the cylinder lock that does not include the any lock-side unlocking code, a particular lock-side unlocking code that matches a key-side unlocking code of the inserted key plate is formed by maintaining the lock tumblers at the positions in the main moving direction that enable the retraction of the locking body into the rotor and preventing the lock tumblers from moving in a disengaging direction to hold the lock tumblers and the key-driven tumblers in undisengageable mesh with each other, such that after the particular lack-side unlocking code is formed, the key plate comprises a use key configured to unlock the cylinder lock, wherein the code setting body held at the disengagement enable position in the initial state is moved to the disengagement disable position to form the particular lock-side unlocking code, wherein the stopper is released to allow the code setting body to be moved to the disengagement disable position by the recovery force of the drive spring to form the particular lock-side unlocking code.

16. The cylinder lock according to claim 15, wherein the stopper is accommodated in the rotor in such a manner as to be urged toward the outside of the rotor and be movable in the main moving direction, wherein an insertion of a key plate causes the stopper to retract into the rotor, disengaging it from the code setting body.

17. The cylinder lock according to claim 15, wherein the stopper is accommodated in the rotor in such a manner as to be urged toward the outside of the rotor and be movable in a main moving direction and when a key plate is inserted, the stopper being movable inwardly of the rotor, wherein, after the key plate is inserted and the rotor is rotated at a predetermined angle, the stopper is disengaged from the code setting body.

18. The cylinder lock according to claim 15, wherein the stopper is operated by an identification portion formed in the key plate.

19. The cylinder lock according to claim 16, wherein the stopper is operated by an identification portion formed in the key plate.

20. The cylinder lock according to claim 17, wherein the stopper is operated by an identification portion formed in the key plate.

* * * * *